US011859957B2

(12) United States Patent
Kash et al.

(10) Patent No.: US 11,859,957 B2
(45) Date of Patent: Jan. 2, 2024

(54) REUSABLE TANDEM SUBS INCLUDING A SIGNAL BAR FOR A PERFORATING GUN SYSTEM

(71) Applicant: G&H Diversified Manufacturing LP, Houston, TX (US)

(72) Inventors: James Edward Kash, Houston, TX (US); Ryan Ward, Tomball, TX (US); Benjamin Vascal Knight, Katy, TX (US); Joe Noel Wells, Lindale, TX (US); Brian Auer, Houston, TX (US); Timmothy Lee, Tomball, TX (US); Steven Zakharia, Houston, TX (US); Charles Levine, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 39 days.

(21) Appl. No.: 17/533,944

(22) Filed: Nov. 23, 2021

(65) Prior Publication Data

US 2022/0163298 A1 May 26, 2022

Related U.S. Application Data

(60) Provisional application No. 63/172,042, filed on Apr. 7, 2021, provisional application No. 63/117,017, filed on Nov. 23, 2020.

(51) Int. Cl.
*F42B 3/103* (2006.01)
*E21B 43/1185* (2006.01)
(Continued)

(52) U.S. Cl.
CPC ..... *F42B 3/103* (2013.01); *E21B 43/119* (2013.01); *E21B 43/1185* (2013.01); *E21B 43/117* (2013.01)

(58) Field of Classification Search
CPC ..... E21B 43/116; E21B 43/117; E21B 43/11855; E21B 43/11857; E21B 43/119; F42B 3/103
(Continued)

(56) References Cited

U.S. PATENT DOCUMENTS 2,598,651 A * 5/1952 Spencer ..... E21B 43/116 175/4.58
11,091,987 B1 * 8/2021 Benker ..... E21B 43/119
(Continued)

OTHER PUBLICATIONS

International Search Report and Written Opinion dated Jun. 13, 2022, for Application No. PCT/US2022/023886.

*Primary Examiner* — John Cooper
(74) *Attorney, Agent, or Firm* — Conley Rose, P.C.

(57) ABSTRACT

A tandem sub for a perforating gun system includes a tubular housing including a longitudinal first end, a longitudinal second end opposite the first end, a central passage defined by an inner surface, an electrical pass-thru assembly including an electrically conductive signal bar having a longitudinal first end defining a first electrical contact of the tandem sub, and a longitudinal second end opposite the first end and defining a second electrical contact of the tandem sub that is longitudinally opposite and electrically connected to the first electrical contact, wherein the signal bar is rigid along the entire longitudinal length thereof extending from the first end to the second end, and wherein the signal bar is coupled to the housing and a central axis of the central passage of the housing intersects the signal bar.

17 Claims, 19 Drawing Sheets

(51) Int. Cl.
*E21B 43/119* (2006.01)
*E21B 43/117* (2006.01)

(58) Field of Classification Search
USPC ..... 89/1.51
See application file for complete search history.

(56) References Cited

U.S. PATENT DOCUMENTS

| | | | | |
|---|---|---|---|---|
| 2012/0247771 | A1* | 10/2012 | Black | E21B 43/1185 166/55 |
| 2020/0362652 | A1* | 11/2020 | Eitschberger | E21B 23/06 |
| 2021/0301599 | A1* | 9/2021 | Mulhern | E21B 43/119 |
| 2022/0034205 | A1* | 2/2022 | Caccialupi | E21B 43/119 |
| 2022/0120548 | A1* | 4/2022 | Sullivan | E21B 43/119 |
| 2022/0251930 | A1* | 8/2022 | Koon | E21B 43/119 |
| 2022/0258103 | A1* | 8/2022 | Eitschberger | F42B 3/10 |
| 2023/0016759 | A1* | 1/2023 | Eitschberger | E21B 17/043 |

* cited by examiner

REUSABLE TANDEM SUBS INCLUDING A SIGNAL BAR FOR A PERFORATING GUN SYSTEM

CROSS-REFERENCE TO RELATED APPLICATIONS

This application claims benefit of U.S. provisional patent application Ser. No. 63/117,017 filed Nov. 23, 2020, and entitled "Reusable Tandem Sub for a Perforating Gun System," and U.S. provisional patent application Ser. No. 63/172,042 filed Apr. 7, 2021, and entitled "Reusable Tandem Sub for a Perforating Gun System," each of which is hereby incorporated herein by reference in its entirety for all purposes.

STATEMENT REGARDING FEDERALLY SPONSORED RESEARCH OR DEVELOPMENT

Not applicable.

BACKGROUND

During completion operations for a subterranean wellbore, it is conventional practice to perforate the wellbore and any casing pipes disposed therein with a perforating gun of a tool string at each production zone to provide a path(s) for formation fluids (e.g., hydrocarbons) to flow from a production zone of a subterranean formation into the wellbore. To ensure that each production zone is isolated within the wellbore, plugs, packers, and/or other sealing devices are installed within the wellbore between each production zone prior to perforation activities. In some applications, one or more of the perforating guns and/or other components of the tool string may comprise a detonator for firing a charge or explosive. For instance, a perforating gun of the tool string may comprise a detonator configured to initiate an explosion of one or more shaped charged of the perforating gun in response to receiving an electrical signal. An electrical signal may be transmitted from the surface to the detonator to activate the detonator and thereby initiate the explosion of the one or more shaped charges.

SUMMARY OF THE DISCLOSURE

An embodiment of a tandem sub for a perforating gun system comprises a tubular housing comprising a longitudinal first end, a longitudinal second end opposite the first end, a central passage defined by an inner surface, wherein the housing is connectable to an outer housing of a perforating gun, and an electrical pass-thru assembly configured to electrically connect to the perforating gun and comprising an electrically conductive signal bar having a longitudinal first end defining a first electrical contact of the tandem sub and configured to establish an electrical connection with a first electrical component separate from and external the tandem sub, and a longitudinal second end opposite the first end and defining a second electrical contact of the tandem sub that is longitudinally opposite and electrically connected to the first electrical contact and configured to establish an electrical connection with a second electrical component separate from and external the tandem sub, wherein the signal bar is rigid along the entire longitudinal length thereof extending from the first end to the second end, wherein the signal bar is coupled to the housing and a central axis of the central passage of the housing intersects the signal bar. In some embodiments, the signal bar is positioned in the central passage of the housing. In some embodiments, the central passage of the housing comprises a longitudinal first end, a longitudinal second end opposite the first end, and wherein the pass-thru assembly creates a pressure seal between the first end and the second end of the central passage. In certain embodiments, the pass-thru assembly comprises a molded insulator sealably adhered to an outer surface of the signal rod and to the inner surface of the central passage of the housing. In certain embodiments, the molded insulator comprises a pair of opposing longitudinal ends, and wherein each longitudinal end of the molded insulator comprises a concave receptacle. In some embodiments, the first end and the second end of the signal bar comprises a concave receptacle, and wherein the concave receptacles of the molded insulator are flush with the conical receptacles of the signal bar. In some embodiments, the molded insulator extends continuously across the entire longitudinal length of the signal bar. In certain embodiments, the signal bar is disk-shaped and coupled to one of the first end and the second end of the tubular housing. In certain embodiments, both the first end and the second end of the signal bar comprises a concave receptacle configured to receive a contact pin. In some embodiments, neither the first end nor the second end of the signal bar is biased outwardly from the central passage of the tubular housing by a biasing member. In some embodiments, the longitudinal length of the signal bar is greater than half the longitudinal length of the central passage of the tubular housing.

An embodiment of a tandem sub for a perforating gun system comprises a tubular housing comprising a longitudinal first end, a longitudinal second end opposite the first end, a central passage defined by an inner surface, wherein the housing is connectable to an outer housing of a perforating gun, and an electrical pass-thru assembly configured to electrically connect to the perforating gun and comprising an electrically conductive signal bar having a longitudinal first end defining a first electrical contact of the tandem sub and configured to establish an electrical connection with a first electrical component separate from and external the tandem sub, and a longitudinal second end opposite the first end and defining a second electrical contact of the tandem sub that is longitudinally opposite and electrically connected to the first electrical contact and configured to establish an electrical connection with a second electrical component separate from and external the tandem sub, wherein neither the first end nor the second end of the signal bar is biased outwardly from the central passage of the tubular housing by a biasing member, wherein the signal bar is coupled to the housing and a central axis of the central passage of the housing intersects the signal bar. In some embodiments, the signal bar is rigid along the entire longitudinal length thereof extending from the first end to the second end. In some embodiments, the longitudinal length of the signal bar is greater than half the longitudinal length of the central passage of the tubular housing. In certain embodiments, the pass-thru assembly comprises a molded insulator sealably adhered to an outer surface of the signal rod and to the inner surface of the central passage of the housing. In certain embodiments, an outer surface of the signal bar and an inner surface of the tubular housing of the tandem sub comprise one or more protrusions configured to interlockingly engage with protrusions of the molded insulator.

An embodiment of a method for producing a tandem sub for a perforating gun system comprises (a) positioning an electrically conductive signal bar in a central passage of a tubular housing of the tandem sub, (b) injecting a mold material into an annulus formed between an outer surface of the signal bar and an inner surface of the tubular housing that sealably adheres to the signal bar and the tubular housing, and (c) machining a concave receptacle into each of a pair of opposed longitudinal ends of the signal bar. In some embodiments, the method comprises (d) machining one or more protrusions onto the inner surface of the tubular housing, and (e) machining one or more protrusions onto the outer surface of the signal bar. In some embodiments, the method comprises (d) machining a concave receptacle into each of a pair of opposed longitudinal ends of the molded insulator. In certain embodiments, the method comprises (d) coupling a pair of blast washers to a pair of outer faces of the inner surface of the tubular housing whereby the blast washers cover at least a portion of a pair of opposed longitudinal ends of the molded insulator.

BRIEF DESCRIPTION OF THE DRAWINGS

For a detailed description of exemplary embodiments of the disclosure, reference will now be made to the accompanying drawings in which.

DETAILED DESCRIPTION

Figure 1:
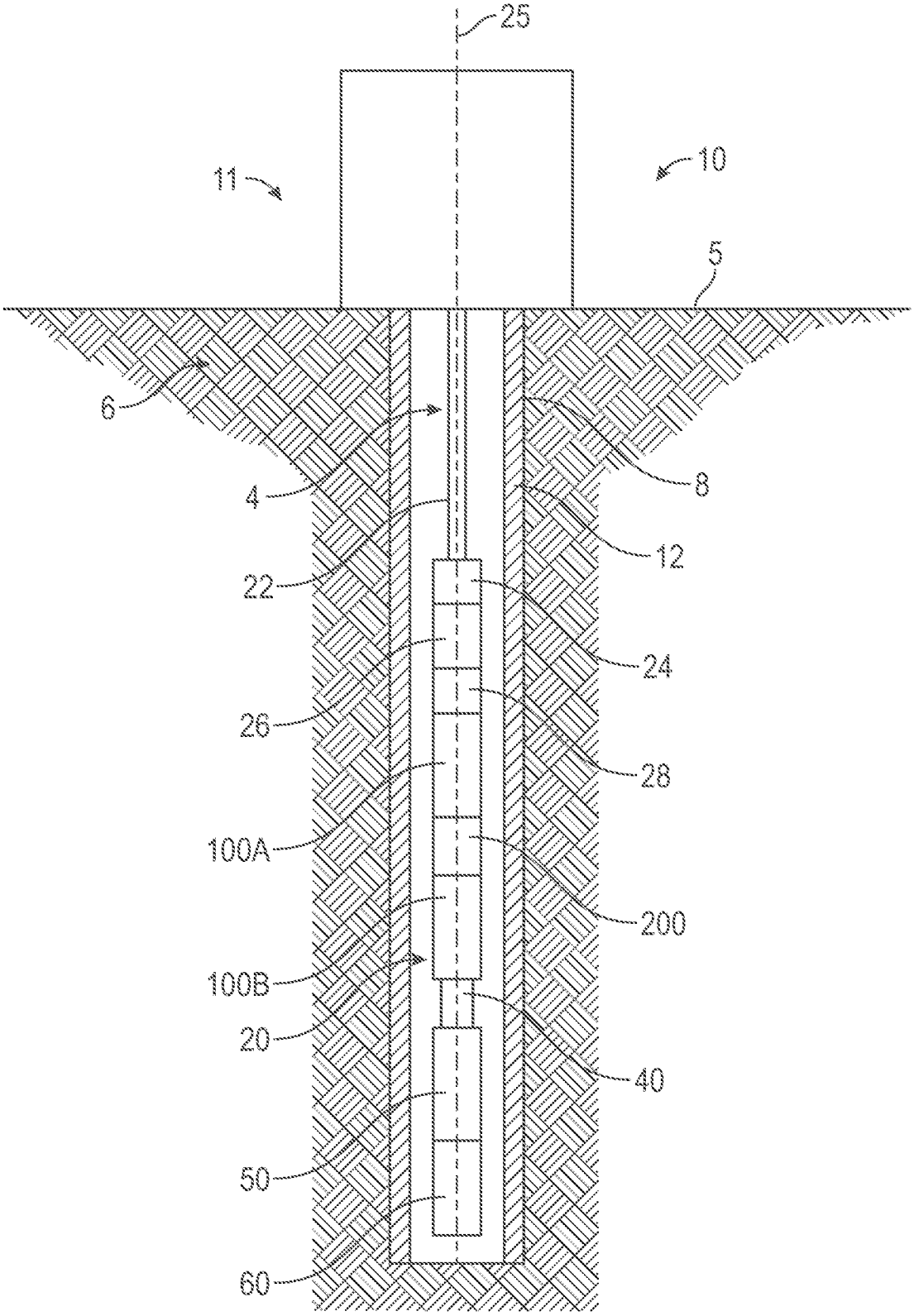
FIG. 1 is a schematic, view of a system for completing a subterranean well including a tool string in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a perforating gun or completion system 10 for completing a wellbore 4 extending into a subterranean formation 6 is shown. In the embodiment of FIG. 1, wellbore 4 is a cased wellbore including a casing string 12 secured to an inner surface 8 of the wellbore 4 using cement (not shown). In some embodiments, casing string 12 generally includes a plurality of tubular segments coupled together via a plurality of casing collars. Completion system 10 includes a surface assembly 11 positioned at a wellsite 13 of system 10, and a tool string 20 deployable into wellbore 4 from a surface 5 using surface assembly 11. Surface assembly 11 may comprise any suitable surface equipment for drilling, completing, and/or operating well 20 and may include, in some embodiments, derricks, structures, pumps, electrical/mechanical well control components, etc. Tool string 20 of completion system 10 may be suspended within wellbore 4 from a wireline 22 that is extendable from surface assembly 11. Wireline 22 comprises an armored cable and includes at least one electrical conductor for transmitting power and electrical signals between tool string 20 and a control system or firing panel of surface assembly 11 positioned at the surface 5.

In some embodiments, system 10 may further include suitable surface equipment for drilling, completing, and/or operating completion system 10 and may include, for example, derricks, structures, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 has a central or longitudinal axis 25 and generally includes a cable head 24, a casing collar locator (CCL) 26, a direct connect sub 28, a pair of perforating guns or tools 100A, 100B, a reusable tandem sub 200, a plug-shoot firing head (PSFH) 40, a setting tool 50, and a downhole or frac plug 60. In other embodiments, the configuration of tool string 20 may vary from that shown in FIG. 1. For example, in other embodiments, tool string 20 may include a fishing neck, weight bars, a release tool, and/or a safety sub selectably restricting electrical communication to one or more components of tool string 20. Cable head 24 is the uppermost component of tool string 20 and includes an electrical connector for providing electrical signal and power communication between the wireline 22 and the other components (CCL 26, perforating guns 100A, 100B, tandem sub 200, PSFH 40, setting tool 50, etc.) of tool string 20. CCL 26 is coupled to a lower end of the cable head 24 and is generally configured to transmit an electrical signal to the surface via wireline 22 when CCL 26 passes through a casing collar of casing string 12, where the transmitted signal may be recorded at surface assembly 11 as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including perforating guns 100A, 100B and associated tools, such as the setting tool 50 and downhole plug 60.

A first or upper perforating gun 100A of tool string 20 is coupled to direct connect sub 28 while a second or lower perforating gun 100B of string 20 is coupled to tandem sub 200 which is positioned between the pair of perforating guns 100A, 100B. Perforating guns 100A, 100B are generally configured to perforate casing string 12 and provide for fluid communication between formation 6 and wellbore 4. As will be described further herein, tandem sub 200 is configured to electrically connect perforating guns 100A, 100B while also providing pressure isolation between perforating guns 100A, 100B. Perforating guns 100A, 100B may be configured similarly to each other. Particularly, each perforating gun 100A, 100B includes a plurality of shaped charges that may be detonated by one or more electrical signals conveyed by the wireline 22 from the firing panel of surface assembly 11 to produce one or more explosive jets directed against casing string 12. Each perforating gun 100A, 100B may comprise a wide variety of sizes such as, for example, 2¾", 3⅛", or 3⅜", wherein the above listed size designations correspond to an outer diameter of the perforating gun 100A, 100B. PSFH 40 of tool string 20 is coupled to a lower end of the lower perforating gun 100B. PSFH 40 couples the lower perforating gun 100B of the tool string 20 to the setting tool 50 and downhole plug 60 and is generally configured to pass a signal from the wireline 22 to the setting tool 50 of tool string 20. In this embodiment, PSFH 40 also includes electrical components to fire the setting tool 50 of tool string 20.

In this embodiment, tool string 20 further includes setting tool 50 and downhole plug 60, where setting tool 50 is coupled to a lower end of PSFH 40 and is generally configured to set or install downhole plug 60 within casing string 12 to fluidically isolate desired segments of the wellbore 4. Once downhole plug 60 has been set by setting tool 50, an outer surface of downhole plug 60 seals against an inner surface of casing string 12 to restrict fluid communication through wellbore 4 across downhole plug 60. Downhole plug 60 of tool string 20 may be any suitable downhole or frac plug known in the art while still complying with the principles disclosed herein.

Figure 2:
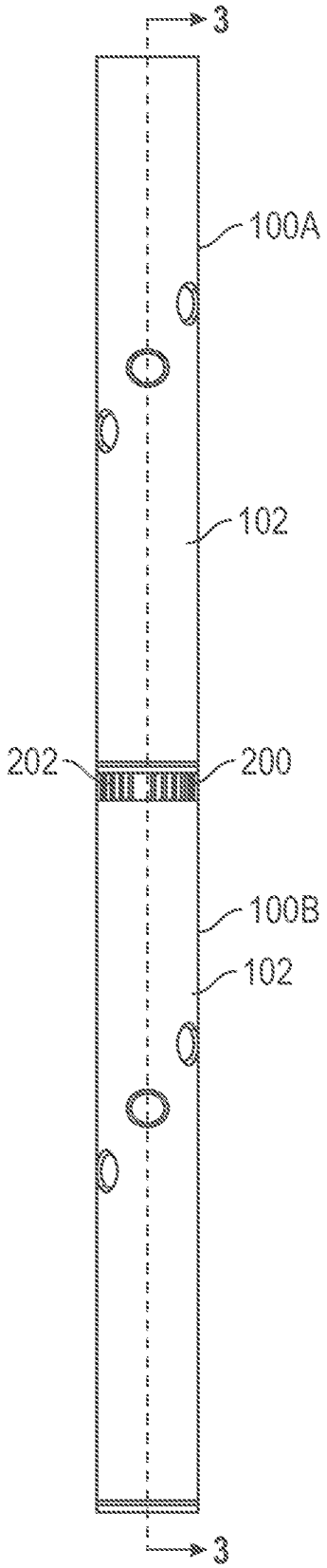
FIG. 2 is a side view of an upper perforating gun, a tandem sub, and a lower perforating gun of the tool string of FIG. 1 according to some embodiments.
Figure 3:
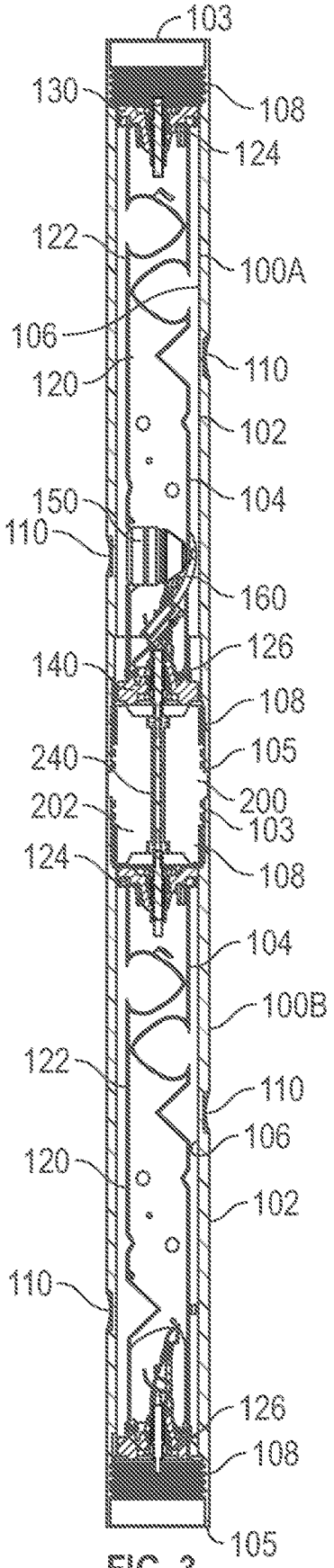
FIG. 3 is a cross-sectional view along lines 3-3 of FIG. 2.
Figure 4:
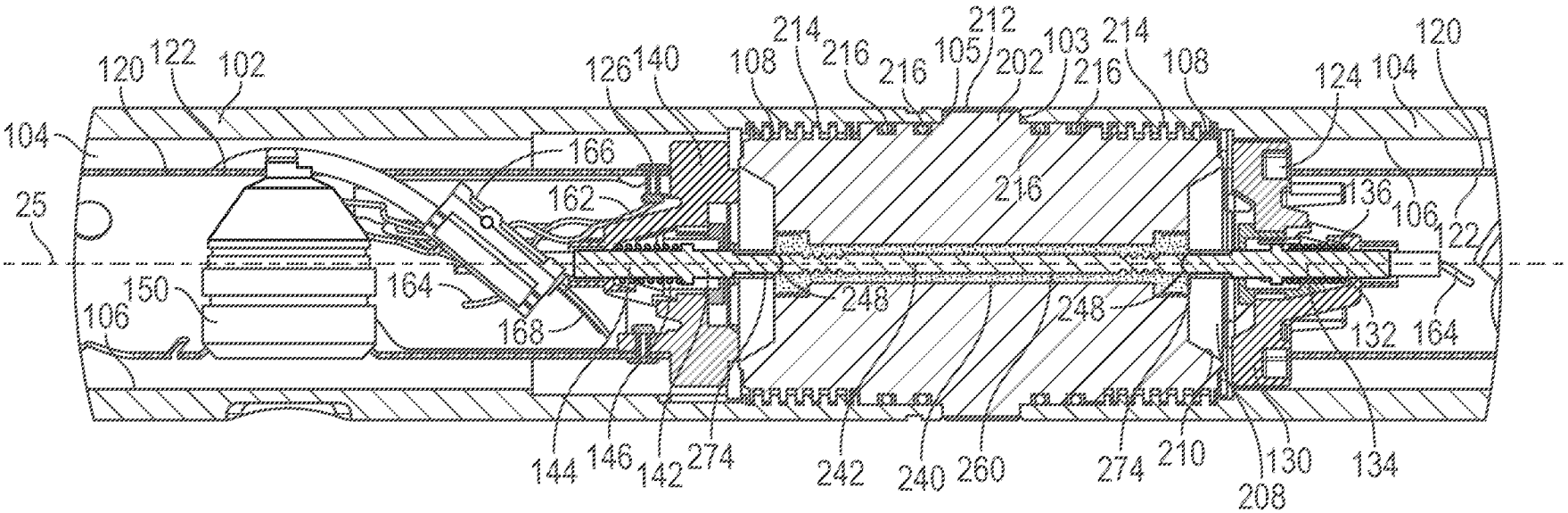
FIG. 4 is a zoomed-in side cross-sectional view of the upper perforating gun, tandem sub, and lower perforating gun of FIG. 2.

Referring to FIGS. 2-5, embodiments of the perforating guns 100A, 100B, and tandem sub 200 of the tool string 20 of FIG. 1 are shown in FIGS. 2-4. In the embodiment of FIGS. 2-5, each perforating gun 100A, 100B generally includes an outer sleeve or housing 102 and a charge tube assembly 120 positionable within the outer housing 102. The outer housing 102 of each perforating gun 100A, 100B includes a first or upper end 103, a second or lower end 105 opposite upper end 103, a central bore or passage 104 within which charge tube assembly 120 is received. A generally cylindrical inner surface 106 defined by central passage 104 may include a releasable or threaded connector 108 at each longitudinal end 103, 105 of outer housing 102. In some embodiments, a generally cylindrical outer surface of the outer housing 102 may include a plurality of circumferentially and axially spaced recesses or scallops 110 to assist with the firing of perforating gun 100A, 100B; however, in other embodiments, outer housing 102 may not include scallops 110. For example, in other embodiments, outer housing 102 may comprise a plurality of annular openings or rings to permit shaped charges of perforating guns 100A, 100B therethrough regardless of the relative angular orientation between the shaped charge and the outer housing 102.

The charge tube assembly 120 of each perforating gun 100A, 100B generally includes a cylindrical charge tube 122, a first or upper endplate 130, and a second or lower endplate 140. The upper endplate 130 is coupled to a first or upper end 124 of charge tube 120 while the lower endplate is coupled to a second or lower end 126 of the charge tube 120 opposite the upper end 124. A plurality of circumferentially and axially spaced shaped charges 150 (only one of which is shown in FIGS. 2-5) are positioned in the charge tube 122 of each charge tube assembly 120. Particularly, each shaped charge 150 has an outer end oriented towards one of the scallops 110 of the outer housing 102, and an inner end oriented towards the central axis of the perforating gun 100A, 100B. The charge tube 122 is configured to couple with and house each shaped charge 150 and orient the outer end of each shaped charge 150 towards one of the scallops 110.

Additionally, each perforating gun 100A, 100B includes det or detonating cord 160 which extends through the charge tube 122 of the perforating gun 100A, 100B. Each shaped charge 150 is configured to initiate an explosion and emit an explosive charge from the outer end thereof and through one of the scallops 110 of outer housing 102 in response to receiving a ballistic signal from the det cord 160 extending through the charge tube 122 to which the shaped charge 150 is coupled. Particularly, the det cord 160 contacts or is otherwise ballistically coupled to the inner end of each shaped charge 150. In this configuration, det cord 160 of each perforating gun 100A, 100B may communicate a ballistic signal to each of the shaped charges 150 of the perforating gun 100A, 100B.

Each perforating gun 100A, 100B additionally includes a pair of electrical signal conductors or cables 162, 164 (shown in FIG. 4) which extend through the charge tube 122 of the perforating gun 100A, 100B. A first electrical cable 162 of the pair of electrical cables 162, 164 may be electrically connected to charge tube 122 and may facilitate the electrical grounding of one or more components of tool string 20, as will be discussed further herein. Additionally, the upper endplate 130 of the charge tube assembly 120 of each perforating gun 100A, 100B comprises an upper electrical connector 132 that is electrically connected or otherwise in signal communication with a second electrical cable 164 of the perforating gun 100A, 100B. The upper electrical connector 132 may comprise a longitudinally translatable contact pin 134 that is biased outwardly from upper endplate 130 by a biasing member 136. The lower endplate 140 of the charge tube assembly 120 of each perforating gun 100A, 100B similarly comprises a lower upper electrical connector 142 that is electrically connected or otherwise in signal communication with the second electrical cable 164 of the perforating gun 100A, 100B. The lower electrical connector 142 may comprise a longitudinally translatable contact pin 144 that is biased outwardly from lower endplate 140 by a biasing member 146.

In this configuration, an electrical signal may be passed between the upper electrical connector 132 and the lower electrical connector 142 via second electrical cable 164. First electrical cable 162 may also be referred to herein as a ground cable 162 while second electrical cable 164 may also be referred to herein as a through-wire cable 164. The through-wire cable 164 of each perforating gun 100A, 100B may be in signal communication with an addressable switch (not shown in FIGS. 2-5) configured to selectably detonate or initiate a detonator 166 of the perforating gun 100A, 100B which is ballistically coupled to det cord 160. Detonator 166 may be positioned within the charge tube 122 of the perforating gun 100A, 100B and may be electrically connected to the switch of the perforating gun 100A, 100B via a pair of electrical leads 168 extending therebetween.

Detonator 166 of each perforating gun 100A, 100B may be selectably detonated by surface assembly 11. For example, surface assembly 11 may transmit a first firing signal addressed to the switch of lower perforating gun 100B through wireline 22 to upper perforating gun 100A. The first firing signal may pass through the upper perforating gun 100A (via through-wire cable 164 of upper perforating gun 100A) and tandem sub 200, entering lower perforating gun 100B. The first firing signal may be communicated to the addressable switch of lower perforating gun 100B via the through-wire cable 164 of lower perforating gun 100B. Being addressed to the lower perforating gun 100B, the switch of gun 100B may detonate the detonator 166 thereof in response to receiving the first firing signal. Similarly, following the actuation of lower perforating gun 100B, surface assembly 11 may transmit a second firing signal addressed to the switch of upper perforating gun 100A through wireline 22 to upper perforating gun 100A. The second firing signal may be communicated to the addressable switch of upper perforating gun 100A via the through-wire cable 164 of gun 100A. Being addressed to the upper perforating gun 100A, the switch of gun 100A may detonate the detonator 166 thereof in response to receiving the second firing signal.

Figure 5:
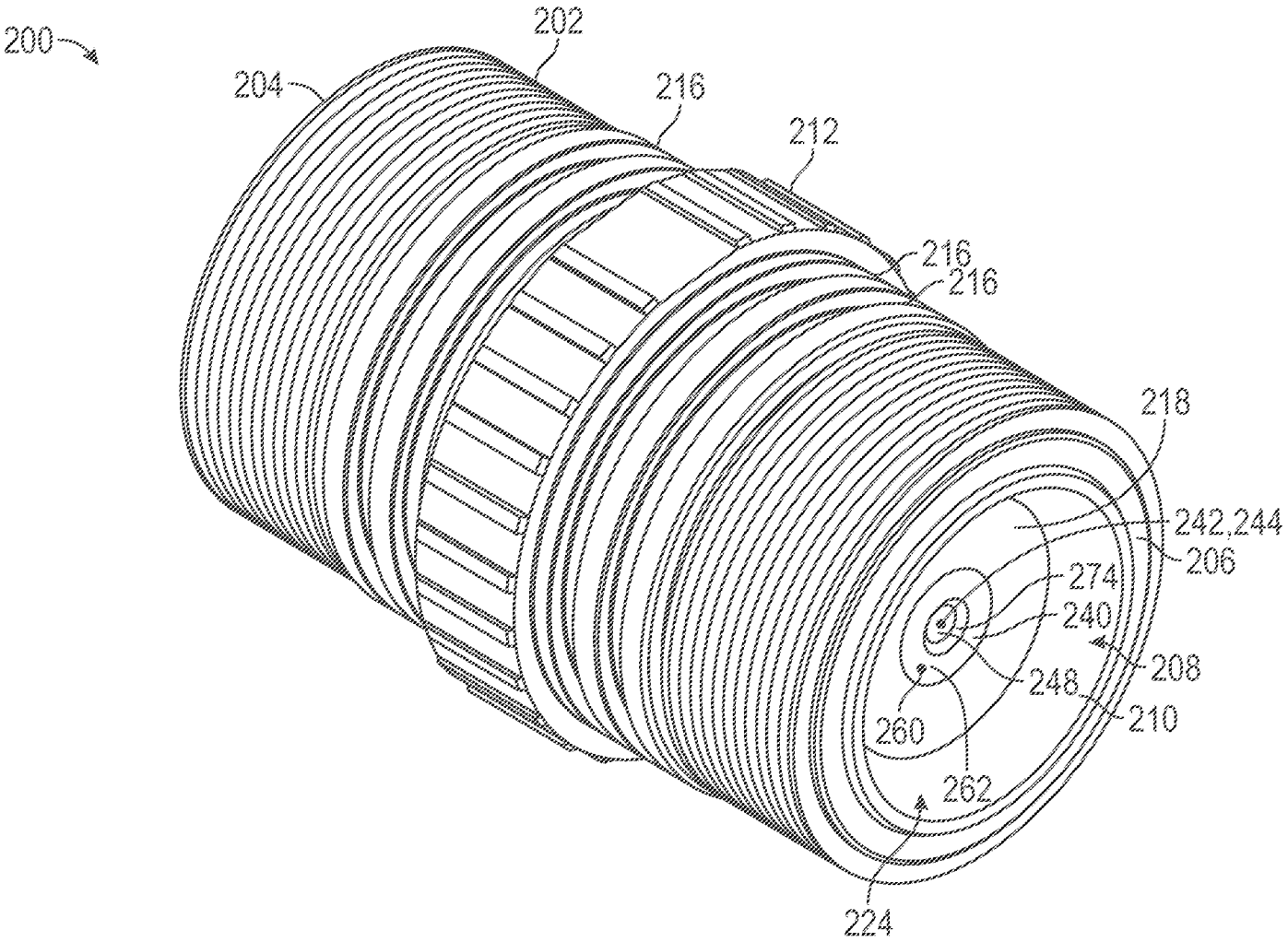
FIG. 5 is a perspective of the tandem sub of FIG. 2.
Figure 6:
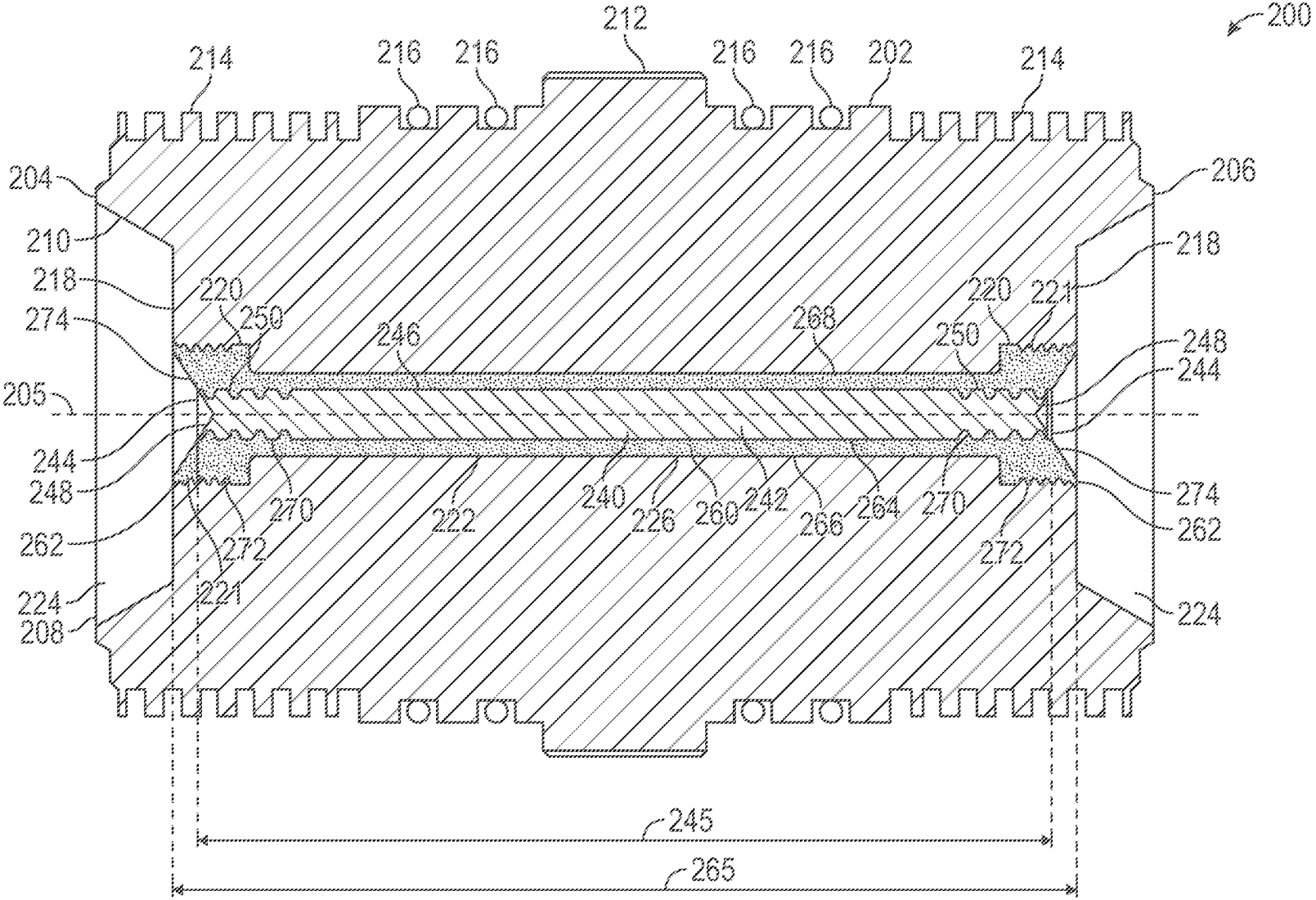
FIG. 6 is a side cross-sectional view of the tandem sub of FIG. 2.

Referring to FIGS. 4-6, tandem sub 200 of tool string 20 is generally configured to communicate electrical signals therethrough and between the pair of perforating guns 100A, 100B. Additionally, tandem sub 200 is configured to provide a pressure bulkhead whereby upper perforating gun 100A is isolated from pressure within lower perforating gun 100B and vice-a-versa. In other words, pressure within central passage 104 of the outer housing 102 of lower perforating gun 100B is not communicated and does not act upon the central passage 104 of the outer housing 102 of upper perforating gun 100A and vice-a-versa. In this manner, the pressure generated within lower perforating gun 100B following the detonation of the shaped charges 150 thereof may not be transferred to the components (e.g., the addressable switch, detonator 160, shaped charges 150) of the upper perforating gun 100A.

In this embodiment, tandem sub 200 of tool string 20 has a central or longitudinal axis 205 (concentric with central axis 25 of tool string 20) and generally includes a cylindrical outer housing 202 and a molded pass-thru assembly 240. Outer housing 202 may be integrally or monolithically formed and may comprise a metallic material such as alloy steel, mild steel, etc. The outer housing 202 of tandem sub 200 includes a first or upper end 204, a second or lower end 206 opposite upper end 204, a central bore or passage 208 defined by a generally cylindrical inner surface extending between ends 204, 206, and a generally cylindrical outer surface 210 extending between ends 204, 206.

As shown particularly in FIG. 6, outer surface 210 of outer housing 202 includes a pair of releasable or threaded connectors 214 positioned at the ends 204, 206 thereof and a pair of annular seal assemblies 216 positioned axially between the releasable connectors 214. The releasable connector 214 positioned at the upper end 204 of outer housing 202 is configured to releasably or threadably connect to the releasable connector 108 positioned at the lower end 105 of the outer housing 102 of upper perforating gun 100A while the releasable connector 214 positioned at the lower end 206 of outer housing 202 is configured to releasably or threadably connect to the releasable connector 108 positioned at the upper end 103 of the outer housing 102 of lower perforating gun 100B. In other embodiments, outer housing 202 may couple to perforating guns 100A, 100B via mechanisms other than releasable connectors 214. Additionally, a first or upper seal assembly 216 of the pair of seal assemblies 216 is configured to sealingly engage the inner surface 106 of the outer housing 102 of upper perforating gun 100A while a second or lower seal assembly 216 of the pair of seal assemblies 216 is configured to sealingly engage the inner surface 106 of the outer housing 102 of lower perforating gun 100B upon assembly of the tandem sub 200 with the perforating guns 100A, 100B. Seal assemblies 216 may each comprise a pair of O-rings positioned in grooves formed in the outer surface 212 of outer housing 202; however, in other embodiments, the configuration of seal assemblies 216 may vary.

The inner surface 210 of outer housing 202 includes a pair of radially extending annular outer shoulders or faces 218, and a pair of receptacles 220 extending axially from the outer shoulders 218. The pair of receptacles 220 may each comprise one or more surface features or protrusions 221 configured to increase an area of receptacles 221 along the portions of receptacles 220 which protrusions 221 extend. Protrusions 221 may comprise one or more annular ridges or splines and thus may also be referred to herein as ridges 221; however, in other embodiments, the configuration of protrusions 221 may vary. For instance, in other embodiments, protrusions 221 may comprise hemispherical, conical, and/or frustoconical projections or dimples which extend radially inwards from central axis 205. The central passage 208 of outer housing 202 comprises a pass-thru passage 222 extending from a first or upper outer face 218 to an opposing second or lower outer face 218. Additionally, the central passage 208 comprises a pair of outer recesses 224 extending between outer faces 218 and the upper and lower ends 204, 206 of outer housing 202. In other embodiments, outer housing 202 may not include receptacles 220 and/or protrusions 221, and instead, pass-thru passage 222 may extend entirely between outer faces 218.

Pass-thru assembly 240 of tandem sub 200 generally comprises an electrical conductor or pass-thru 242 and a molded insulator 260 in which the electrical contact 242 is positioned. In this embodiment, electrical conductor 242 comprises a cylindrical signal bar and thus may also be referred to herein as signal bar 242. As shown particularly in FIG. 6, signal bar 242 comprises a pair of opposing longitudinal ends 244 and a generally cylindrical outer surface 246 extending between longitudinal ends 244. Signal bar 242 may be integrally or monolithically formed and may comprise an electrically conductive material such as, for example, brass. Signal bar 242 has a longitudinal length 245 extending between the longitudinal ends 244. Each longitudinal end 244 of signal bar 242 may be spaced inwardly (towards the center of tandem sub 200) from the outer faces 218 of outer housing 202 such that an axially extending gap is formed between each longitudinal end 244 and the outer faces 218. Signal bar 242 is rigid entirely across the longitudinal length 245 and each end 244 is not biased radially outwards from passage 222 by a biasing member. In other words, pass-thru assembly 240 does not include a biasing member for biasing any component or feature of pass-thru assembly 240, including signal bar 242. Additionally, the longitudinal length 245 of signal bar 242 is greater than half the longitudinal length of the passage 222.

A conical recess or receptacle 248 may be formed in each longitudinal end 244 of signal bar 242 such that each conical receptacle 248 extends concentrically with central axis 205. The outer surface 246 of signal bar 242 may comprise one or more surface features or protrusions 250 configured to increase an area of outer surface 246 along the portions of outer surface 246 which protrusions 250 extend. Protrusions 250 may comprise one or more annular ridges or splines and thus may also be referred to herein as ridges 250; however, in other embodiments, the configuration of protrusions 250 may vary. For instance, in other embodiments, protrusions 250 may comprise hemispherical, conical, and/or frustoconical projections or dimples which extend radially outwards from central axis 205.

As shown particularly in FIG. 4, molded insulator 260 of pass-thru assembly 240 may comprise a pair of opposed longitudinal ends 262 and may entirely fill an annulus 226 of the central passage 208 of outer housing 202 formed between the outer surface 246 of signal bar 242 and the inner surface 210 of outer housing 202. The molded insulator 260 may be integrally or monolithically formed and may comprise an electrically insulating material. In some embodiments, molded insulator 260 may comprise a polymeric material such as Polyether ether ketone (PEEK), Polyetherimide (PEI), etc.; however, molded insulator 260 may comprise various electrically insulating materials. In this manner, molded insulator 260 may electrically insulate signal bar 242 from outer housing 202 which may comprise an electrically conductive material in some embodiments.

The longitudinal ends 262 of molded insulator 260 may be positioned at the interfaces between receptacles 220 and outer faces 218 of outer housing 202. Molded insulator 260 may have a maximum length 265 extending between longitudinal ends 262 which is less than the maximum length 245 of signal bar 242. Molded insulator 260 may adhere to both the inner surface 210 of outer housing 202 and the outer surface 246 of signal bar 242 thereby coupling or affixing signal bar 242 to outer housing 202 whereby relative axial and rotational movement between signal bar 242 and outer housing 202 may be restricted.

Molded insulator 260 may be annular and comprise a central passage 264 defined by a generally cylindrical inner surface 266 extending between longitudinal ends 262 and a generally cylindrical outer surface 268 also extending between ends 262. Signal bar 242 may be received within the central passage 264 of molded insulator 260. The inner surface 266 of molded insulator 260 may sealingly engage and adhere to the outer surface 246 of signal bar 242 while the outer surface 268 of molded insulator 260 may sealingly engage and be adhered to the inner surface 21 of outer housing 202, thereby restricting fluid communication and isolating pressure across annulus 226.

The inner surface 266 of molded insulator 260 may comprise one or more surface features or inner protrusions 270 configured to increase an area of inner surface 266 along the portions of inner surface 266 which inner protrusions 270 extend. Similarly, the outer surface 268 of molded insulator 260 may comprise one or more surface features or outer protrusions 272 configured to increase an area of outer surface 268 along the portions of outer surface 268 which outer protrusions 272 extend. Protrusions 270, 272 may comprise one or more annular ridges or splines and thus may also be referred to herein as ridges 270, 272; however, in other embodiments, the configuration of protrusions 270, 272 may vary. For instance, in other embodiments, protrusions 270, 272 may each comprise hemispherical, conical, and/or frustoconical projections or dimples which extend radially with respect to central axis 205.

Outer protrusions 272 of molded insulator 260 may interlockingly engage with protrusions 221 of outer housing 202 to enhance the degree or quality of coupling between molded insulator 260 and outer housing 202. Similarly, inner protrusions 270 of molded insulator 260 may interlockingly engage with the protrusions 250 of signal bar 242 to enhance the degree or quality of coupling between molded insulator 260 and signal bar 242. In this manner, protrusions 270, 272 may allow tandem sub 200 to be operated in relatively more extreme applications (applying a greater differential pressure across pass-thru assembly 240) while maintaining a seal and pressure isolation between the upper end 204 and lower end 206 of outer housing 202. However, in other embodiments, outer housing 202 may not include protrusions 221, signal bar 242 may not include protrusions 250, and molded insulator 260 may not include protrusions 270, 272; instead, adhesion between molded insulator 260 and the outer housing 202 and signal bar 242 formed during the formation of molded insulator 260 may maintain the coupling between molded insulator 260 and both outer housing 202 and signal bar 242.

A frustoconical recess or receptacle 274 may be formed in each longitudinal end 262 of molded insulator 260 such that each frustoconical receptacle 274 extends concentrically with central axis 205. The longitudinal ends 244 of signal bar 242 may be positioned at inner ends of frustoconical receptacles 274. In other words, each longitudinal end 244 of signal bar 242 is positioned in a corresponding frustoconical receptacle 274 of molded insulator 260. In some embodiments, the conical receptacles 248 of signal bar 242 are flush with the frustoconical receptacles 274 of molded insulator 260. An axial gap is formed between the longitudinal ends 244 of signal bar 242 and the longitudinal ends 262 of molded insulator 260 with the longitudinal ends 244 of signal bar 242 being recessed within the frustoconical receptacles 274 of molded insulator 260. In this configuration, there is no outward projection or pin of signal bar 242 extending from one of the frustoconical receptacles 274 that may be inadvertently damaged or broken off during operation of tandem sub 200.

Following the assembly of tandem sub 200 with perforating guns 100A, 100B, the contact pin 144 of the lower electrical connector 142 of upper perforating gun 100A may be received in the conical receptacle 248 positioned at an upper longitudinal end 244 of signal bar 242, thereby establishing electrical contact and signal communication between upper perforating gun 100A and tandem sub 200. Similarly, contact pin 134 of the upper electrical connector 132 of lower perforating gun 100B may be received in the conical receptacle 248 positioned at a lower longitudinal end 244 of signal bar 242, thereby establishing electrical contact and signal communication between lower perforating gun 100B and tandem sub 200. The conical shape of frustoconical receptacles 274 of molded insulator 260 and conical receptacles 248 of signal bar 242 may guide contact pins 134, 144 into aligned engagement with conical receptacles 248.

Figure 7:
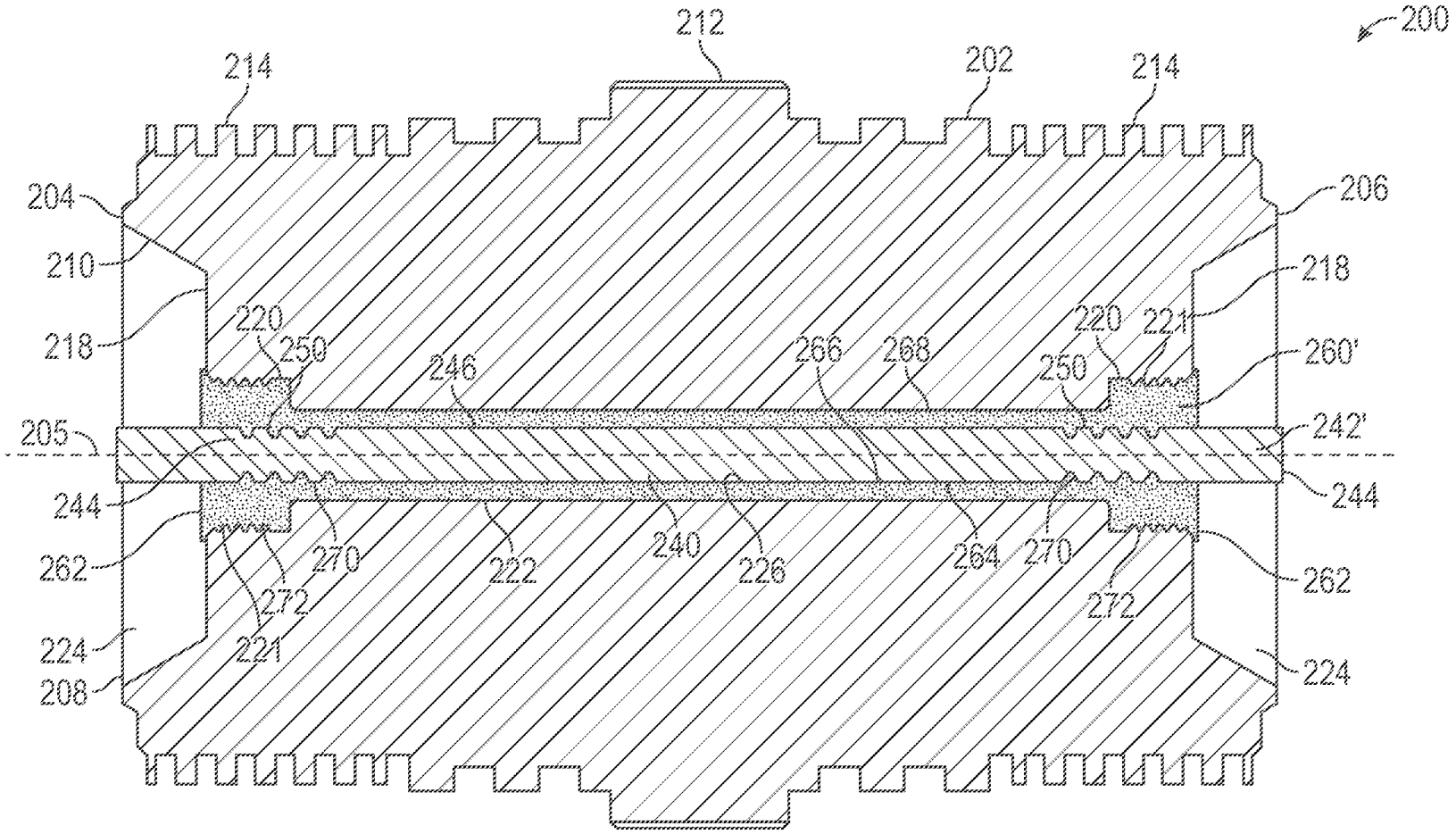
FIG. 7 is a side cross-sectional view of a partially produced tandem sub of FIG. 2 according to some embodiments.

Referring to FIGS. 6, 7, an exemplary method for producing tandem sub 200 is shown therein. Beginning at FIG. 7, following the fabrication of outer housing 202 and a cylindrical rod 242' (shown in FIG. 7) from which signal bar 242 will be formed, cylindrical rod 242' may be held centrally within the central passage 204 of outer housing 202 by a fixture of a mold assembly (not shown in FIGS. 6, 7). With cylindrical rod 242' positioned centrally in outer housing 202, a pair of endcaps (not shown in FIGS. 6-8) of the mold assembly may be inserted into the outer recesses 224 of outer housing 202 such that the endcaps sealingly engage the outer faces 218 of housing 202.

With the endcaps so positioned, mold material (e.g., a polymeric material in some embodiments) may be injected (via a port formed in one of the endcaps) into the annulus 226 until the entire annulus 226 has been filled with the mold material. A molded member 260' (shown in FIG. 7) may be formed in annulus 226 following curing of the mold material, the molded insulator 260 being formed from the molded member 260'. Particularly, longitudinal ends of both the cylindrical rod 242' (now sealably adhered to the outer housing 202 by molded member 260') and molded member 260' may be machined to form conical recesses 248 in cylindrical rod 242' and frustoconical recesses 274 in molded member 260', thereby forming signal bar 242 and molded insulator 260, respectively. FIGS. 6, 7 represent one method for producing the tandem sub 200 shown in FIG. 6 and in other embodiments other manufacturing methods may be used for producing tandem sub 200.

As described above, tandem sub 200 provides an electrical pass-thru for signal communication between perforating guns 100A, 100B via the pass-thru assembly 240 thereof. Instead of relying on separate and distinct sealing elements, such as elastomeric O-rings, to seal the ends of tandem sub 200, sub 200 may utilize the sealable adhesion produced between molded insulator 260 and the outer housing 202 and signal bar 242 to seal the ends of tandem sub 200 and to isolate pressure thereacross. Given that pass-thru assembly 240 does not rely on fragile elastomeric sealing elements (e.g., one or more O-rings, etc.) which must be refurbished or replaced after each use of tandem sub 200, tandem sub 200 may be reused an indefinite number of times without needing to replace pass-thru assembly 240.

Additionally, by comprising only a single signal bar 242 that may be encased in a monolithically formed and relatively thick molded insulator 260 that extends continuously across the entire length 245 of signal bar 242, pass-thru assembly 240 may reduce the risk of electrical leakage between signal bar 252 and outer housing 242 relative to other electrical contact assemblies which do not include a monolithic insulator. In some embodiments, a ratio of an outer diameter of molded insulator 260 to an outer diameter of signal bar 242 may be five or greater. Further, given that pass-thru assembly 240 may comprise only a single monolithically formed signal bar 242, the electrical connection formed between perforating guns 100A, 100B via tandem sub 200 includes only two electrical contact points—the points of contact between contact pins 144, 134 of perforating guns 100A, 100B, respectively, and the longitudinal ends 244 of signal bar 242. Thus, pass-thru assembly 240 may have a lesser number of electrical contact points, which are susceptible to failure during operation, relative to other assemblies which rely on a plurality of components to provide electrical continuity.

Figure 8:
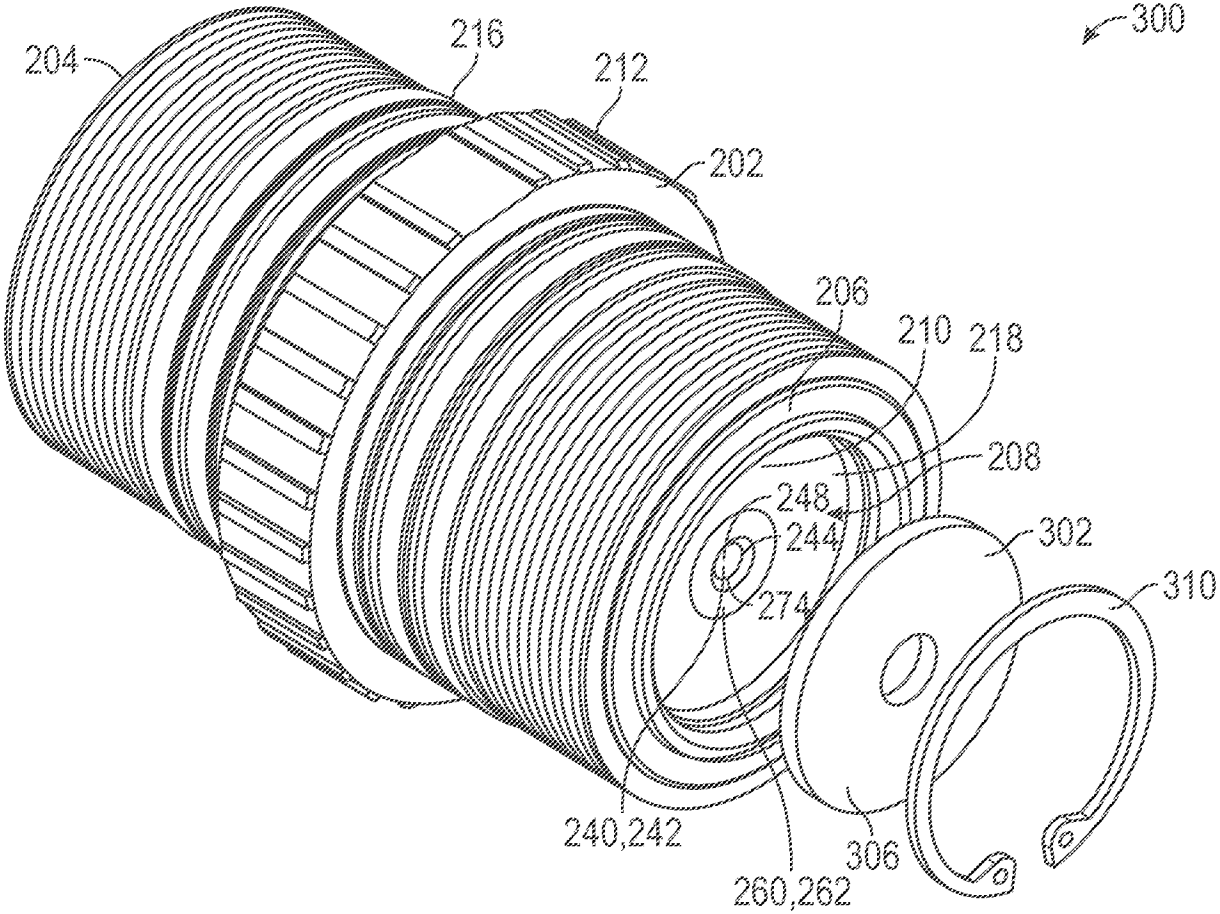
FIG. 8 is a perspective view of another tandem sub according to some embodiments.
Figure 9:
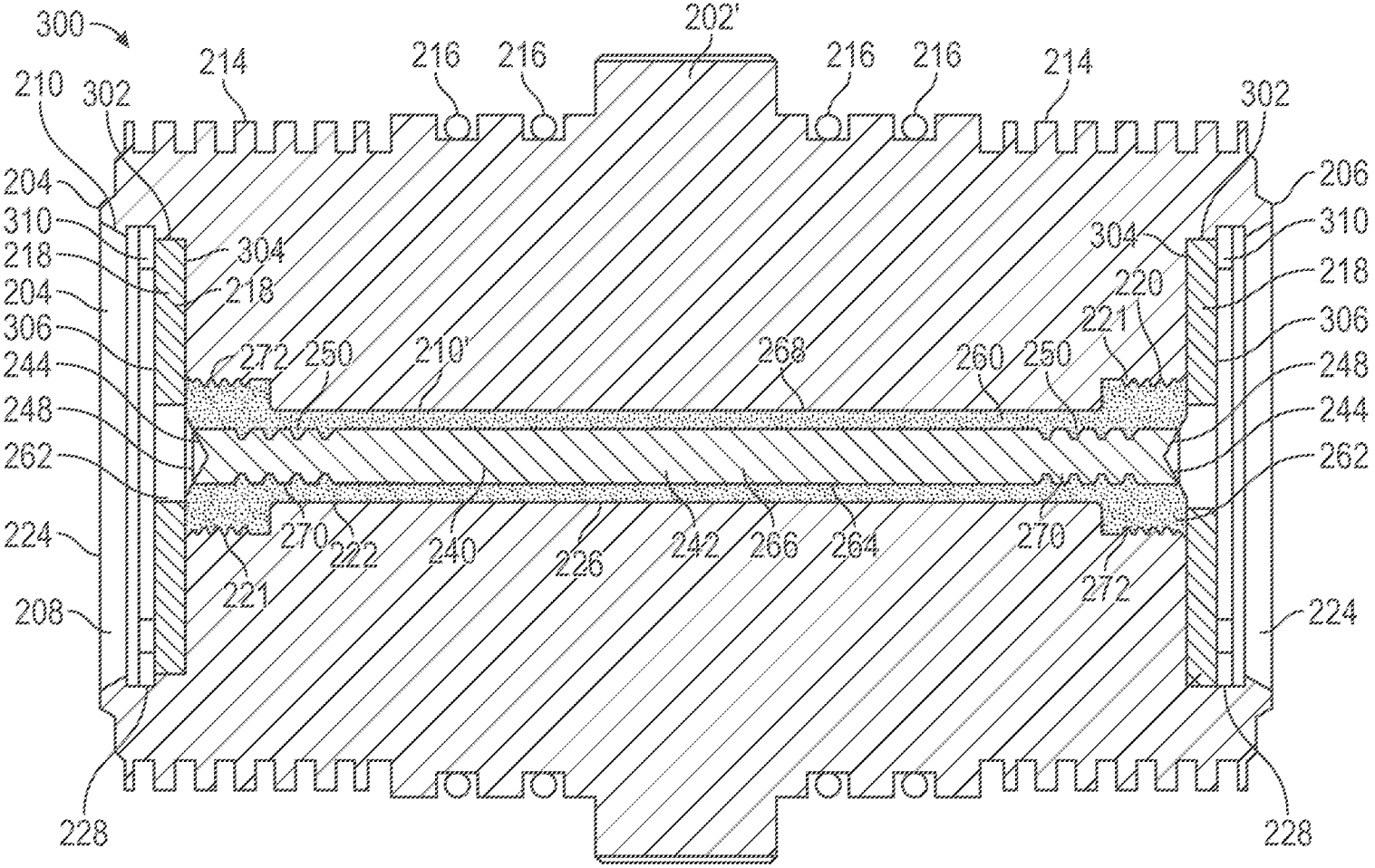
FIG. 9 is a side cross-sectional view of the tandem sub of FIG. 8.

Referring to FIGS. 8, 9, another embodiment of a tandem sub 300 is shown. Tandem sub 300 may be used in conjunction with or in lieu of the tandem sub 200 shown in FIGS. 4-7. Additionally, tandem sub 300 may include features in common with tandem sub 200 shown in FIGS. 4-7, and shared features are labeled similarly. Tandem sub 300 generally includes an outer housing 202', pass-thru assembly 240, and a pair of blast washers 302 and retaining rings 310. Blast washers 302 may each be disc shaped and including an annular inner face 304 and an annular outer face 306.

Blast washers 302 may act as a sacrificial element configured to absorb the impact of the detonation of a perforating gun (e.g., one of perforating guns 100A, 100B) positioned adjacent thereto while protecting the inner surface 210' of outer housing 202'. In some embodiments, blast washers 302 may comprise a hardened material whereas in other embodiments blast washers 302 may comprise a material having similar properties as the material comprising outer housing 202'. When assembled with outer housing 202', the inner face 304 of blast washers 302 may contact and cover the outer faces 218 of outer housing 202' and potentially at least a portion of the longitudinal ends 262 of molded insulator 260, thereby protecting outer faces 218 and the longitudinal ends 262 of molded insulator 260 from the impact of the detonation of a perforating gun positioned adjacent tandem sub 300. By protecting outer faces 218 of outer housing 202 and the longitudinal ends 262 of molded insulator 260, blast washers 302 may reduce or eliminate a potential need to resurface (e.g., grind, machine, and/or polish, etc.) outer faces 218 and/or the longitudinal ends 262 of molded insulator 260 after one or more uses of tandem sub 300, thereby minimizing the costs for operating tandem sub 300.

The outer housing 202' of tandem sub 300 may be similar in configuration to the outer housing 202 shown in FIGS. 4-7 except that the inner surface 210' of outer housing 202' may comprise a pair of annular recesses or lips 228 formed therein proximal the ends 204, 206 of outer housing 202'. Retaining rings 310 may be snapped into lips 228 of outer housing 202' to secure blast washers 302 to outer housing 202 via contact between retaining rings 310 and the outer faces of blast washers 302. In some embodiments, retaining rings 310 may comprise radially expandable C-rings.

Figure 10:
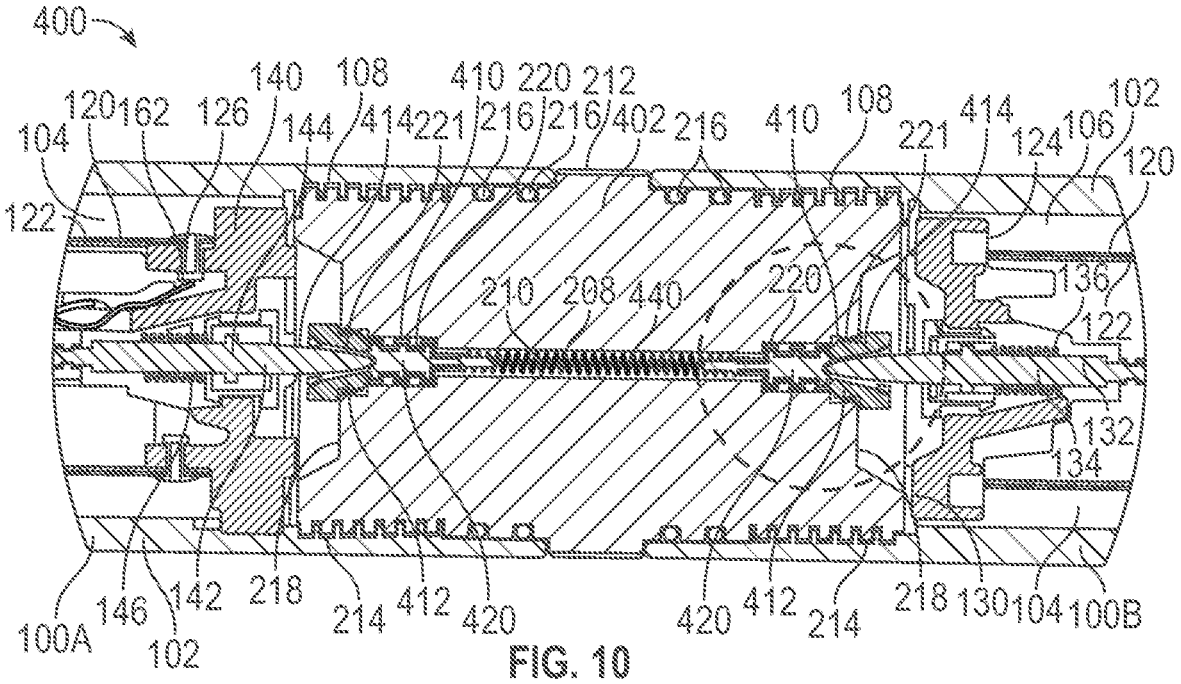
FIG. 10 is a side cross-sectional view of another tandem sub according to some embodiments.
Figure 11:
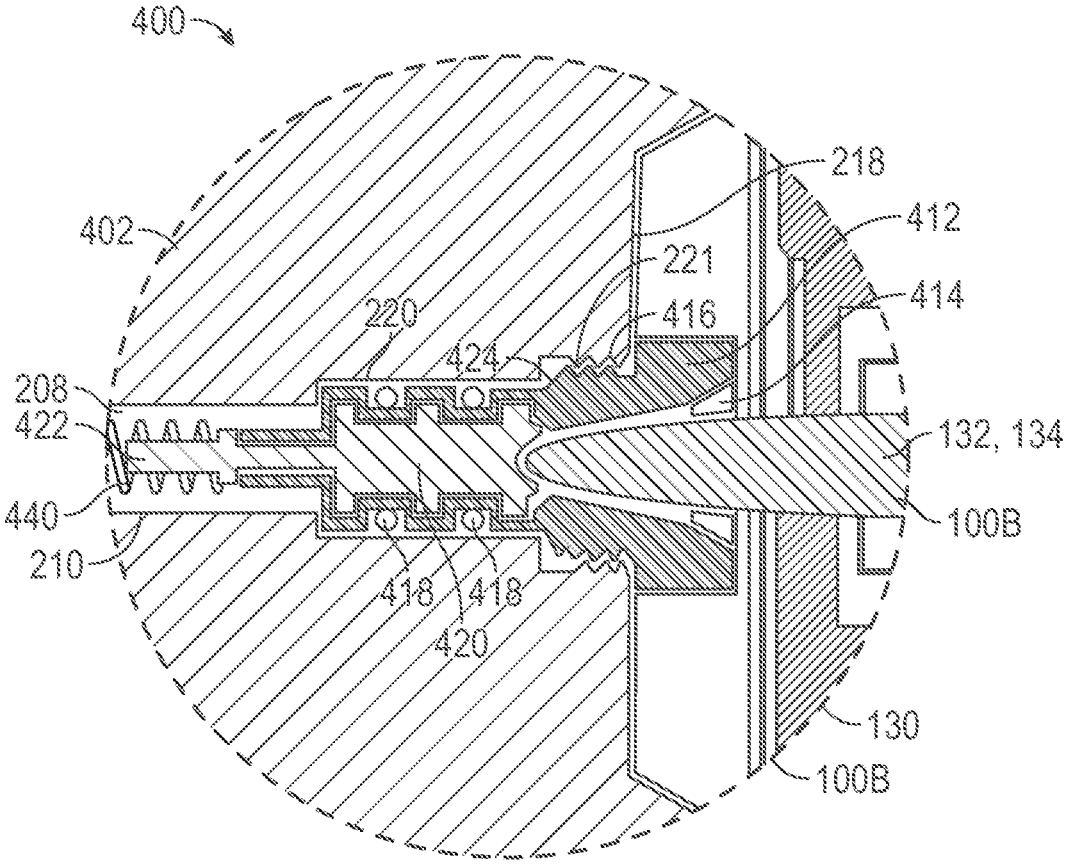
FIG. 11 is a zoomed-in side cross-sectional view of the tandem sub of FIG. 10.

Referring to FIGS. 10, 11, another embodiment of a tandem sub 400 is shown which may be used in conjunction with or in lieu of the tandem sub 200 shown in FIGS. 4-7. Additionally, tandem sub 400 may include features in common with tandem sub 200 shown in FIGS. 4-7, and shared features are labeled similarly. Tandem sub 400 generally includes an outer housing 402, a pair of pressure bulkheads or pass-thru assemblies 410, and an electrical connector 440 extending between the pair of pressure bulkheads 410. Housing 402 is similar in configuration to the housing 202 of tandem sub 200 shown in FIGS. 4-7, and thus will be not described in detail.

In this embodiment, each pressure bulkhead 410 comprises an electrically insulating outer retainer 412 and an inner electrical connector 420. Retainer 412 may be overmolded onto the electrical connector 420. In some embodiments, retainer 412 may comprise a plastic material while electrical connector 420 comprises a metallic, electrically conductive material. As shown particularly in FIG. 11, retainer 412 of each pressure bulkhead 410 comprises a receptacle 414 which guides and receives the contact pin 134, 144 of one of the electrical connectors 132, 142. Additionally, a generally cylindrical outer surface of the retainer 412 of each pressure bulkhead 410 comprises a releasable or threaded coupler 416. In this embodiment, protrusions of 221 of outer housing 402 comprise internal threads which threadably couple with the threaded connectors 416 of pressure bulkheads 410 to retain pressure bulkheads 410 within the central passage 208 of outer housing 402. Further, a pair of annular seals or O-rings 418 are positioned within corresponding grooves formed on the outer surface of each retainer 412. O-rings 418 seal against the inner surface 210 of outer housing 402 to provide bi-directional pressure isolation between upper perforating gun 100A and lower perforating gun 100B.

Also, as shown particularly in FIG. 11, the electrical connector 420 of each pressure bulkhead 410 comprises a first or inner end comprising a contact pin 422 and a second or outer end comprising a conical recess or receptacle 424. Contact pin 422 projects outwardly from retainer 412 while conical receptacle 424 is recessed within retainer 412 such that the receptacle 414 of retainer 412 extends towards the conical receptacle 424 of electrical connector 420. The contact pin 422 of each pressure bulkhead 410 contacts electrical connector 440 to form an electrical connection between pressure bulkheads 410. In this embodiment, electrical connector 440 comprises a biasing element or coil spring; however, in other embodiments, electrical connector 440 may comprise other types of electrical connectors including electrically conductive tubes, rods, cables, etc.

When tandem sub 400 is assembled with perforating guns 100A, 100B, the contact pins 134, 144 of electrical connectors 132, 142 are received in the conical receptacles 424 of the electrical connectors 420 of pressure bulkheads 410 to establish an electrical connection between upper perforating gun 100A and lower perforating gun 100B. Thus, tandem sub 400 may both provide electrical connectivity between perforating guns 100A, 100B while also isolating or preventing the transmission of pressure from upper perforating gun 100A to lower perforating gun 100B and from lower perforating gun 100B to upper perforating gun 100A.

Figure 12:
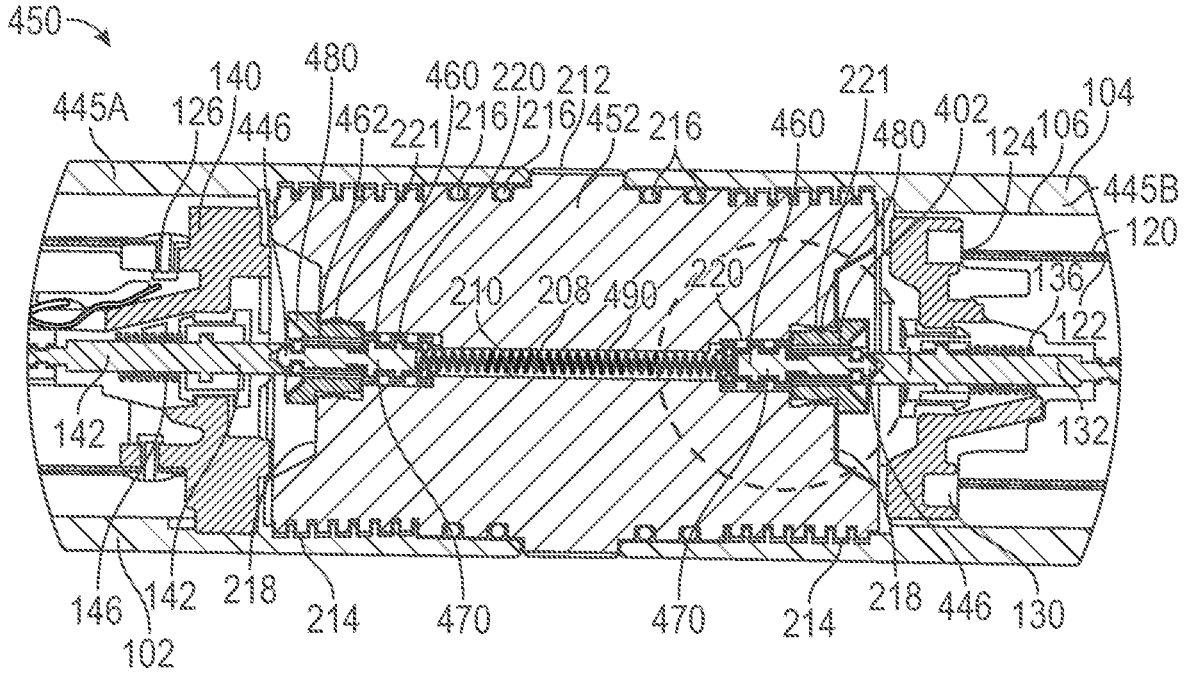
FIG. 12 is a side cross-sectional view of another tandem sub according to some embodiments.
Figure 13:
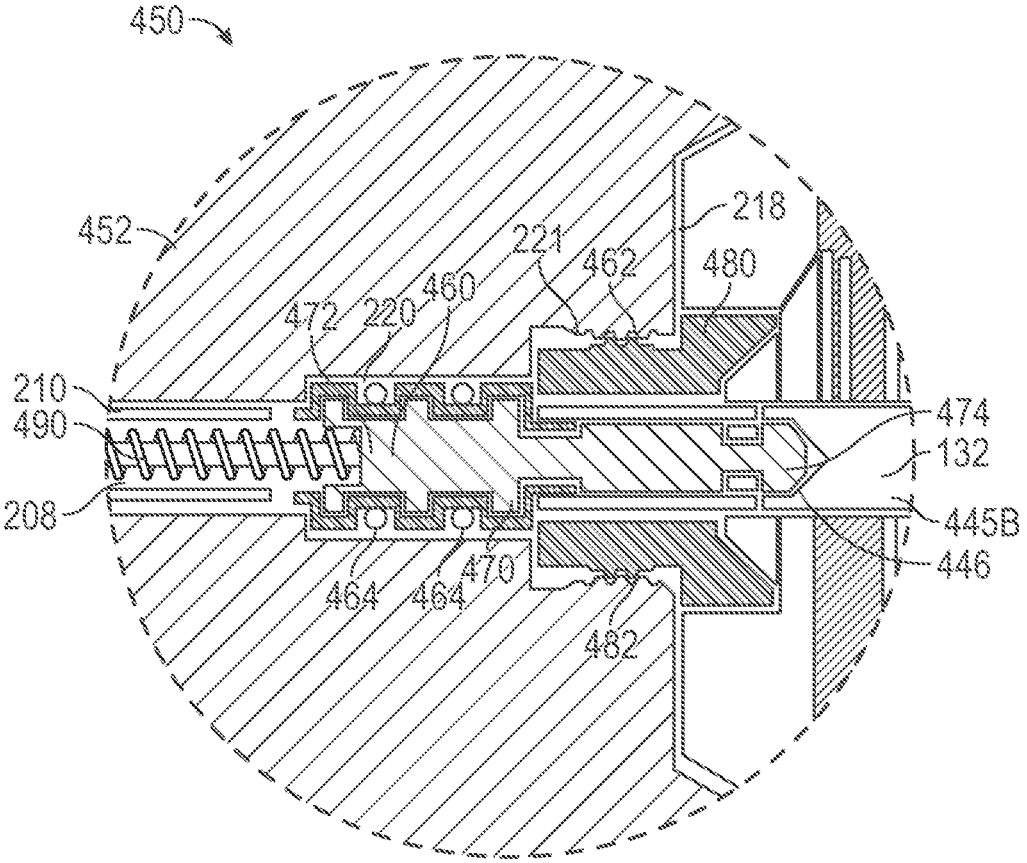
FIG. 13 is a zoomed-in side cross-sectional view of the tandem sub of FIG. 12.

Referring to FIGS. 12, 13, another embodiment of a tandem sub 450 is shown which may be used in conjunction with or in lieu of the tandem sub 200 shown in FIGS. 4-7. Tandem sub 450 may include features in common with tandem sub 200 shown in FIGS. 4-7 and tandem sub 400 shown in FIGS. 10, 11, and shared features are labeled similarly. Tandem sub 450 is configured to electrically connect and provide bi-directional pressure isolation between perforating guns 445A, 445B. Perforating guns 445A, 445B are similar to the perforating guns 100A, 100B, respectively, shown in FIGS. 3, 4, except that electrical connectors 132, 142 each comprise receptacles 446 rather than pin connectors 134, 144, respectively.

Tandem sub 450 generally includes an outer housing 452, a pair of pressure bulkheads or pass-thru assemblies 460, a pair of bulkhead retainers 480, and an electrical connector 490 extending between the pair of pressure bulkheads 460. Housing 452 is similar in configuration to the housing 202 of tandem sub 200 shown in FIGS. 4-7, and thus will be not described in detail. In this embodiment, each pressure bulkhead 460 comprises an outer electrical insulator 462 and an inner electrical connector 470. Insulator 462 may be overmolded onto the electrical connector 470. In some embodiments, insulator 462 may comprise a plastic material while electrical connector 470 comprises a metallic, electrically conductive material. In other embodiments, insulator 462 may comprise an electrically insulating coating applied onto electrical connector 470. For example, insulator 462 may comprise a non-conductive metallic material which is coated onto electrical connector 470 via an anodizing process. As shown particularly in FIG. 13, a pair of annular seals or O-rings 464 are positioned within corresponding grooves formed on the outer surface of the insulator 462 of each pressure bulkhead 460. O-rings 464 seal against the inner surface 210 of outer housing 402 to provide bi-directional pressure isolation between an upper perforating gun 445A and a lower perforating gun 445B.

Also, as shown particularly in FIG. 13, the electrical connector 470 of each pressure bulkhead 460 comprises a first or inner end comprising a conical recess or receptacle 472 and a second or outer end comprising a contact pin 474. Contact pin 474 projects outwardly from insulator 462 while conical receptacle 472 is recessed within insulator 462. The contact pins 474 of pressure bulkheads 460 may be received in the receptacles 446 of the electrical connectors 142, 132 of perforating guns 445A, 445B, respectively, to form an electrical connection between tandem sub 450 and perforating guns 445A, 445B. Additionally, opposing terminal ends of the electrical connector 490 are received in the conical receptacles 472 of the electrical connectors 470 of pressure bulkheads 460 to establish an electrical connection between the pair of pressure bulkheads 460. In this embodiment, electrical connector 490 comprises a biasing element or coil spring; however, in other embodiments, electrical connector 490 may comprise other types of electrical connectors including electrically conductive tubes, rods, cables, etc.

The bulkhead retainers 480 are configured to retain pressure bulkheads 460 within their respective receptacles 220 of outer housing 452. In this embodiment, each bulkhead retainer 480 comprises an outer surface including a releasable or threaded connector. Additionally, in this embodiment, protrusions of 221 of outer housing 452 comprise internal threads which threadably couple with the threaded connectors 482 of the bulkhead retainers 480 to retain or capture pressure bulkheads 460.

When tandem sub 450 is assembled with perforating guns 445A, 445B, an electrical connection is established between perforating guns 445A, 445B via the pressure bulkheads 460 and electrical connector 490. Additionally, pressure isolation is provided between perforating guns 445A, 445B via the sealing engagement between pressure bulkheads 460A and outer housing 452 whereby the transmission of pressure from upper perforating gun 445A to lower perforating gun 445B and from lower perforating gun 445B to upper perforating gun 445A is prevented.

Figure 14:
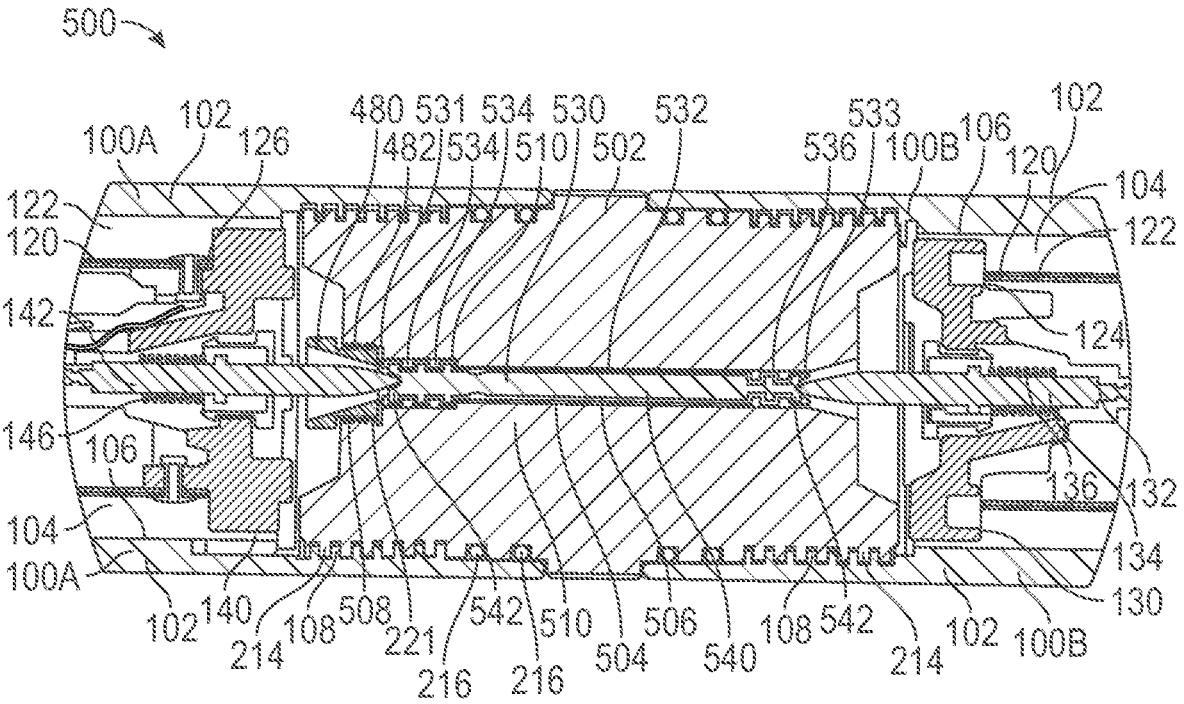
FIGS. 14-22 are side cross-sectional views of other tandem subs according to some embodiments.

Referring to FIG. 14, another embodiment of a tandem sub 500 is shown which may be used in conjunction with or in lieu of the tandem sub 200 shown in FIGS. 4-7. Tandem sub 500 may include features in common with tandem sub 200 shown in FIGS. 4-7 and tandem sub 450 shown in FIGS. 12, 13, and shared features are labeled similarly. Tandem sub 500 generally includes an outer housing 502, a pressure bulkhead or pass-thru assembly 530, and a single bulkhead retainer 480.

Outer housing 502 of tandem sub 500 includes features in common with the outer housing 202 shown in FIGS. 4-7, and shared features are labeled similarly. Outer housing 502 includes a central bore or passage 504 defined by a generally cylindrical inner surface 506 extending between opposing ends of outer housing 502. In this embodiment, the inner surface 506 of outer housing 502 includes a first or outer receptacle and a second or inner receptacle 510 each positioned proximal a first or upper end of the outer housing 502 which connects to upper perforating gun 100A. Outer receptacle 508 of inner surface 506 has a greater diameter than a diameter of inner receptacle 510 and is separated from inner receptacle 510 by an annular shoulder formed on inner surface 506. Additionally, inner receptacle 510 has a larger diameter than a diameter of the segment or portion of inner surface 506 which extends directly from inner receptacle 510. An annular second or inner shoulder 512 is positioned between inner receptacle 510 and the segment of inner surface 506 which extends directly from inner receptacle 510.

Pressure bulkhead 530 of tandem sub 500 includes an outer electrical insulator 532 and an inner electrical conductor or connector 540. A first or upper pair of annular seals or O-rings 534 are positioned within corresponding grooves formed on an outer surface of the insulator 532 proximal a first or upper end thereof while a second or lower pair of annular seals or O-rings 536 are positioned within corresponding grooves formed on the outer surface of the insular 532 proximal a second or lower end thereof. Upper O-rings 534 have a greater diameter than a diameter of lower O-rings 536. Each pair of O-rings 534, 536 sealingly engage the inner surface 506 of outer housing 502. Insulator 532 may be overmolded onto the electrical connector 540. In some embodiments, insulator 532 may comprise a plastic material while electrical connector 540 comprises a metallic, electrically conductive material. In other embodiments, insulator 532 may comprise an electrically insulating coating applied onto electrical connector 540. For example, insulator 532 may comprise a non-conductive metallic material which is coated onto electrical connector 54 via an anodizing process. The electrical connector 540 of pressure bulkhead 530 comprises a pair of conical recesses or receptacles 542 positioned at opposing terminal ends thereof.

In this embodiment, a first or upper end 531 of pressure bulkhead 530 is greater in outer diameter than an outer diameter of a second or lower end 533 of pressure bulkhead 530 opposite upper end 531. The upper end 531 of pressure bulkhead 530 is received within the inner receptacle 510 of outer housing 502 while the lower end 533 of pressure bulkhead 530 is received within the segment of the inner surface 506 of outer housing 502 which extends directly from inner receptacle 510. Bulkhead retainer 480 is received in the outer receptacle 508 and the threaded connector 482 thereof threadably connects to threads 221 of outer housing 502.

Pressure bulkhead 530 may be slidably inserted into the central passage 504 of outer housing 502. Following the coupling of pressure bulkhead 480 with outer housing 502, relative movement between pressure bulkhead 530 and outer housing 502 is restricted via engagement between the upper end 531 of pressure bulkhead 530 and both the bulkhead retainer 480 and the inner shoulder 512 of outer housing 502. Following coupling of tandem sub 500 with perforating guns 100A, 100B, guns 100A, 100B may be electrically connected via contact between the contact pins 134, 144 of electrical connectors 132, 142, respectively, and the conical receptacles 542 of pressure bulkhead 530.

Figure 15:
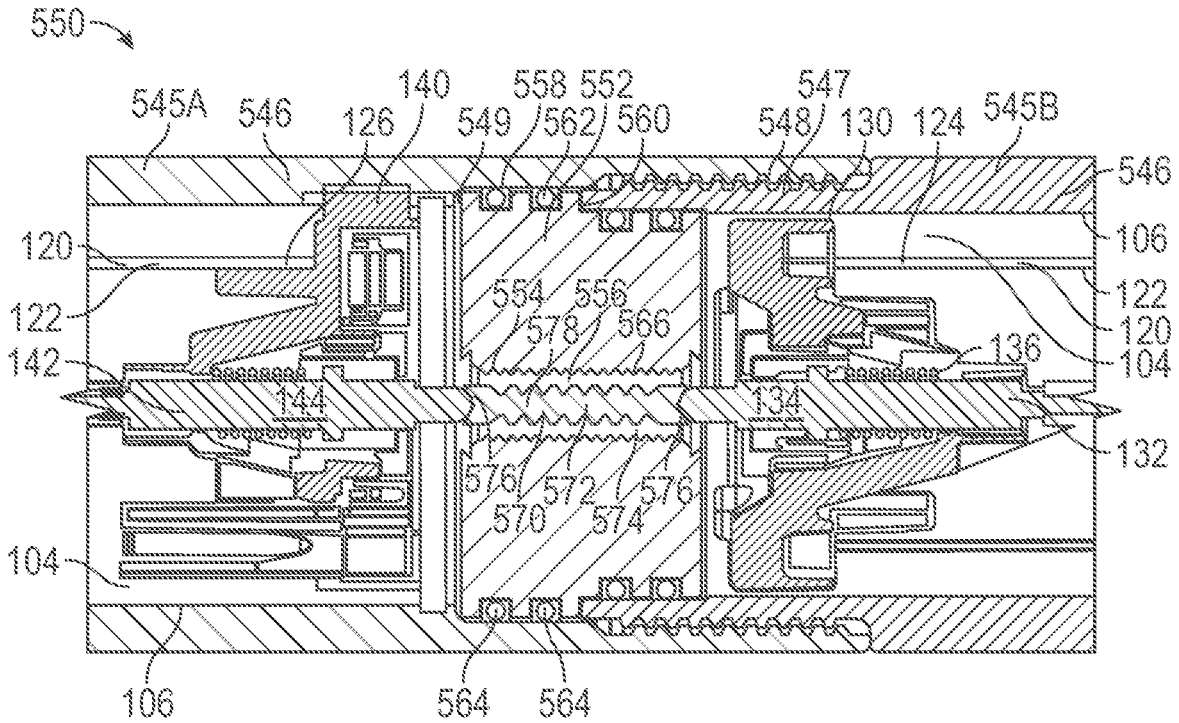

Referring to FIG. 15, another embodiment of a tandem sub 550 is shown which may be used in conjunction with or in lieu of the tandem sub 200 shown in FIGS. 4-7. Tandem sub 550 may include features in common with tandem sub 200 shown in FIGS. 4-7, and shared features are labeled similarly. Tandem sub 550 generally includes an outer housing 552 and a pressure bulkhead or pass-thru assembly 570.

As with the tandem subs described above, including tandem sub 200 shown in FIGS. 4-7, tandem sub 550 is generally configured to electrically connect upper and lower perforating guns together while isolating pressure within the lower perforating gun from the upper perforating gun, and isolating pressure within the upper perforating gun from the lower perforating gun. In this embodiment, tandem sub 550 is configured to electrically connect and provide bi-directional pressure isolation between perforating guns 545A, 545B. Perforating guns 545A, 545B are similar to the perforating guns 100A, 100B, respectively, shown in FIGS. 3, 4, except that an outer housing 546 of each perforating gun 545A, 545B comprises a first or upper pin connector 547 and a second or lower box connector 548 opposite the upper pin connector 547. Thus, instead of including a housing 102 which comprises box threaded connectors 108 at each end thereof with a tandem sub threadably connected between outer housings 102 (shown in FIGS. 3, 4), the outer housings 546 of perforating guns 545A, 545B may be threadably connected directly together in a box-by-pin configuration. In this configuration, tandem sub 550 is sandwiched between the outer housings 546 of perforating guns 545A, 545B instead of being threadably connected wither either or both of perforating guns 545A, 545B, as will be discussed further herein. Allowing for the direct connection of lower perforating gun 545B with upper perforating gun 545A may allow for a reduction of the overall axial length of the assembled perforating guns 545A, 545B, thereby increasing the ease at which a tool string comprising perforating guns 545A, 545B may be deployed through a wellbore Outer housing 552 includes a central bore or passage 554 defined by a generally cylindrical inner surface 556 extending between opposing ends of outer housing 552, and a generally cylindrical outer surface 558 also extending between the opposing ends of outer housing 552. In this embodiment, the outer surface 558 of outer housing 552 comprises an annular shoulder 560, a first or upper pair of annular seals or O-rings 562, and a second or lower pair of annular seals or O-rings 564. In this embodiment, shoulder 560 is positioned between the upper O-rings 562 and the lower O-rings 564 whereby a diameter of the upper O-rings 562 is greater than a diameter of the lower O-rings 564.

Pass-thru assembly 570 of tandem sub 550 generally comprises an electrical conductor or pass-thru 572 and a molded insulator 574 in which the electrical conductor 572 is positioned. In this embodiment, electrical conductor 572 comprises a cylindrical signal bar and thus may also be referred to herein as signal bar 572. Signal bar 572 may be integrally or monolithically formed and may comprise an electrically conductive material such as, for example, brass. A conical recess or receptacle 576 may be formed in each longitudinal end of signal bar 572. A generally cylindrical outer surface of signal bar 572 may comprise one or more surface features or protrusions 578. Protrusions 578 may comprise one or more annular ridges or splines and thus may also be referred to herein as ridges 578; however, in other embodiments, the configuration of protrusions 578 may vary. For instance, in other embodiments, protrusions 578 may comprise hemispherical, conical, and/or frustoconical projections or dimples which extend radially outwards.

Molded insulator 574 of pass-thru assembly 570 may entirely fill and thereby seal an annulus 566 of the central passage 554 of outer housing 552 formed between the outer surface of signal bar 572 and the inner surface 556 of outer housing 552. The molded insulator 574 may be integrally or monolithically formed and may comprise an electrically insulating material. In some embodiments, molded insulator 574 may comprise a polymeric material such as Polyether ether ketone (PEEK), Polyetherimide (PEI), etc.; however, molded insulator 574 may comprise various electrically insulating materials.

Molded insulator 574 may adhere to both the inner surface 556 of outer housing 552 and the outer surface of signal bar 572 thereby coupling or affixing signal bar 572 to outer housing 552 whereby relative axial and rotational movement between signal bar 572 and outer housing 552 may be restricted. Additionally, ridges 578 of signal bar 572 may interlock with corresponding ridges of molded insulator 574 formed during the molded process to lock the molded insulator 574 with signal bar 572. Further, a plurality of protrusions or ridges 568 formed on the inner surface 556 of housing 552 may interlock with corresponding ridges of molded insulator 574 formed during the molding process to lock molded insulator 574 with housing 552. In this manner, molded insulator 574 may electrically insulate signal bar 572 from outer housing 552 while also preventing the communication of pressure from within lower perforating gun 545B to upper perforating gun 545A and from within upper perforating gun 100A to the lower perforating gun 545B. In this embodiment, signal bar 572 may be molded to insulator 574 in its completed or fully machined state such that no additional machining must be performed following the forming of molded insulator 574 onto signal bar 572. This is in contrast to the signal bar 242 shown in FIGS. 4-7 which is machined following the forming of molded member 260'.

Tandem sub 550 may be assembled with perforating guns 545A, 545B by inserting a lower end of tandem sub 550 into an upper end of lower perforating gun 545B. The housing 546 of upper perforating gun 545A may then be threadably connected to the housing 546 of lower perforating gun 545B whereby signal bar 572 enters in electrical connectivity with the electrical connectors 142, 132 of perforating guns 545A, 545B, respectively. In this assembled configuration, an upper end of the outer housing 552 of tandem sub 550 contacts an annular inner shoulder 549 of the housing 546 of upper perforating gun 545A while an upper terminal end of the housing 546 of the lower perforating gun 545B contacts the shoulder 560 of outer housing 552, thereby restricting relative axial movement between tandem sub 550 and both perforating guns 545A, 545B.

Figure 16:
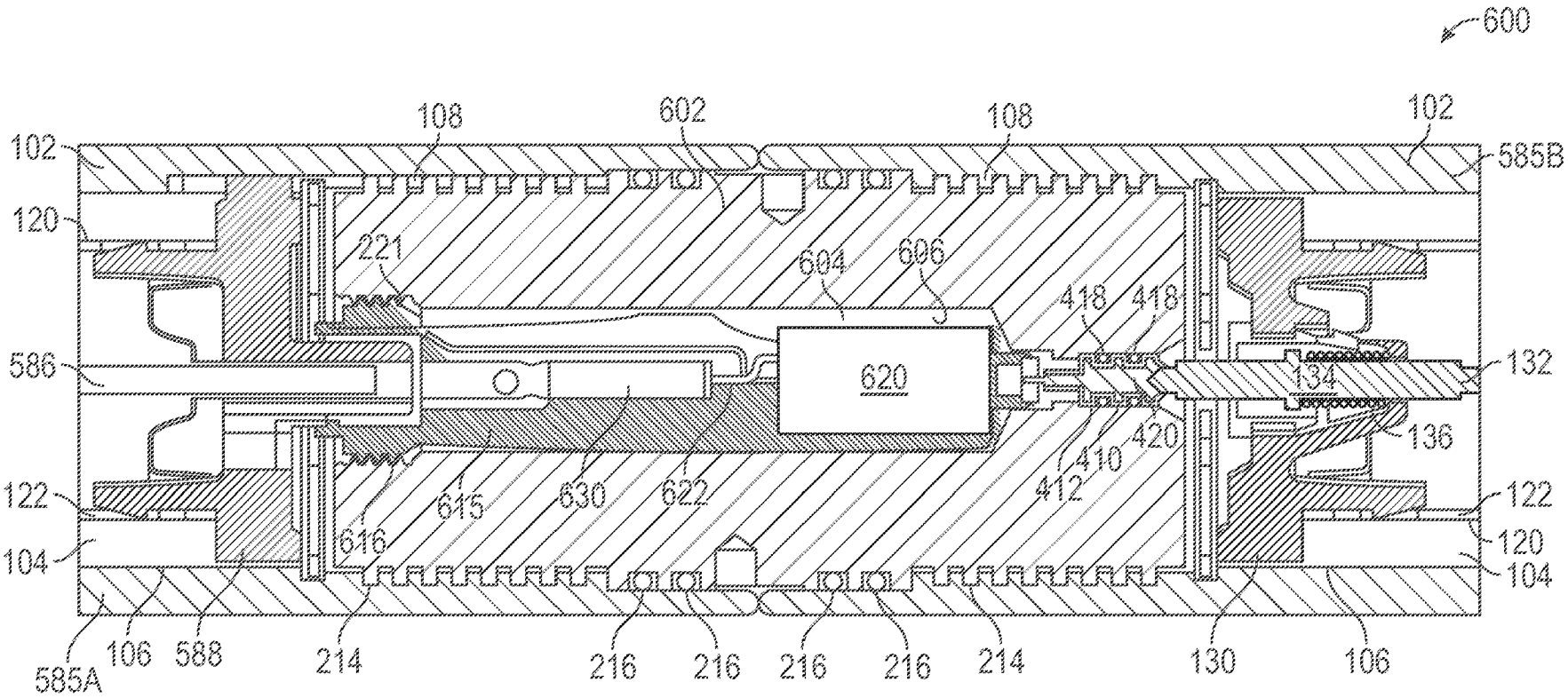

Referring to FIG. 16, another embodiment of a tandem sub 600 is shown which may be used in conjunction with or in lieu of the tandem sub 200 shown in FIGS. 4-7. Tandem sub 600 may include features in common with tandem sub 200 shown in FIGS. 4-7, and shared features are labeled similarly. Tandem sub 600 generally includes an outer housing 602, a single pressure bulkhead 410, an addressable switch 620, and a detonator 630.

As with the tandem subs described above, including tandem sub 200 shown in FIGS. 4-7, tandem sub 600 is generally configured to electrically connect upper and lower perforating guns together while isolating pressure within the lower perforating gun from the upper perforating gun, and isolating pressure within the upper perforating gun from the lower perforating gun. In this embodiment, tandem sub 600 is configured to electrically connect and provide bi-directional pressure isolation between perforating guns 585A, 585B. Perforating guns 585A, 585B are similar to the perforating guns 100A, 100B, respectively, shown in FIGS. 3, 4, except that the detonator and addressable switch associated with each perforating gun 585A, 585B is positioned within a tandem sub 600 associated with the particular perforating gun 585A, 585B. For example, the tandem sub 600 shown in FIG. 16 is associated with upper perforating gun 585A and thus addressable switch 620 is configured to detonate the shaped charge of upper perforating gun 585A via detonator 630 and a det cord 586 which extends through a lower endplate 588 of upper perforating gun 585A. Lower perforating gun 585B may be configured similarly as upper perforating gun 585A and thus another detonator and addressable switch positioned downhole from lower perforating gun 585B (e.g., within another tandem sub 600) may be associated with lower perforating gun 585B.

The outer housing 602 of tandem sub 600 comprises a central passage 604 defined by a generally cylindrical inner surface 606 extending between opposed ends of outer housing 602. The pressure bulkhead 410 sealingly engages the inner surface 606 of outer housing 602 to prevent the communication of pressure from lower perforating gun 585B to upper perforating gun 585A, and from upper perforating gun 585A to lower perforating gun 585B.

In this embodiment, a chassis 615 of tandem sub 600 may be received within the central passage 604 of outer housing 602 and which houses both addressable switch 620 and detonator 630. Chassis 615 includes an outer surface comprising a releasable or threaded connector 616 which is configured to threadably connect with internal threads 221 of outer housing 602 to secure both addressable switch 620 and detonator 630 within the central passage 604 of outer housing 602. The addressable switch 620 received in housing 615 is electrically connected to detonator 630 via a first electrical cable or wire 622. Additionally, in this embodiment, addressable switch 620 is electrically connected to upper perforating gun 100A via a second electrical cable or wire 624 which connect to an electrical connector (e.g., a pin-and-socket style connector) formed in the lower endplate 588 of upper perforating gun 585A. Further, addressable switch 620 comprises an electrical connector (e.g., a pin-and-socket style connector) which electrically connects with pressure bulkhead 410 to provide an electrical connection between addressable switch 620 and the lower perforating gun 585B.

Figure 17:
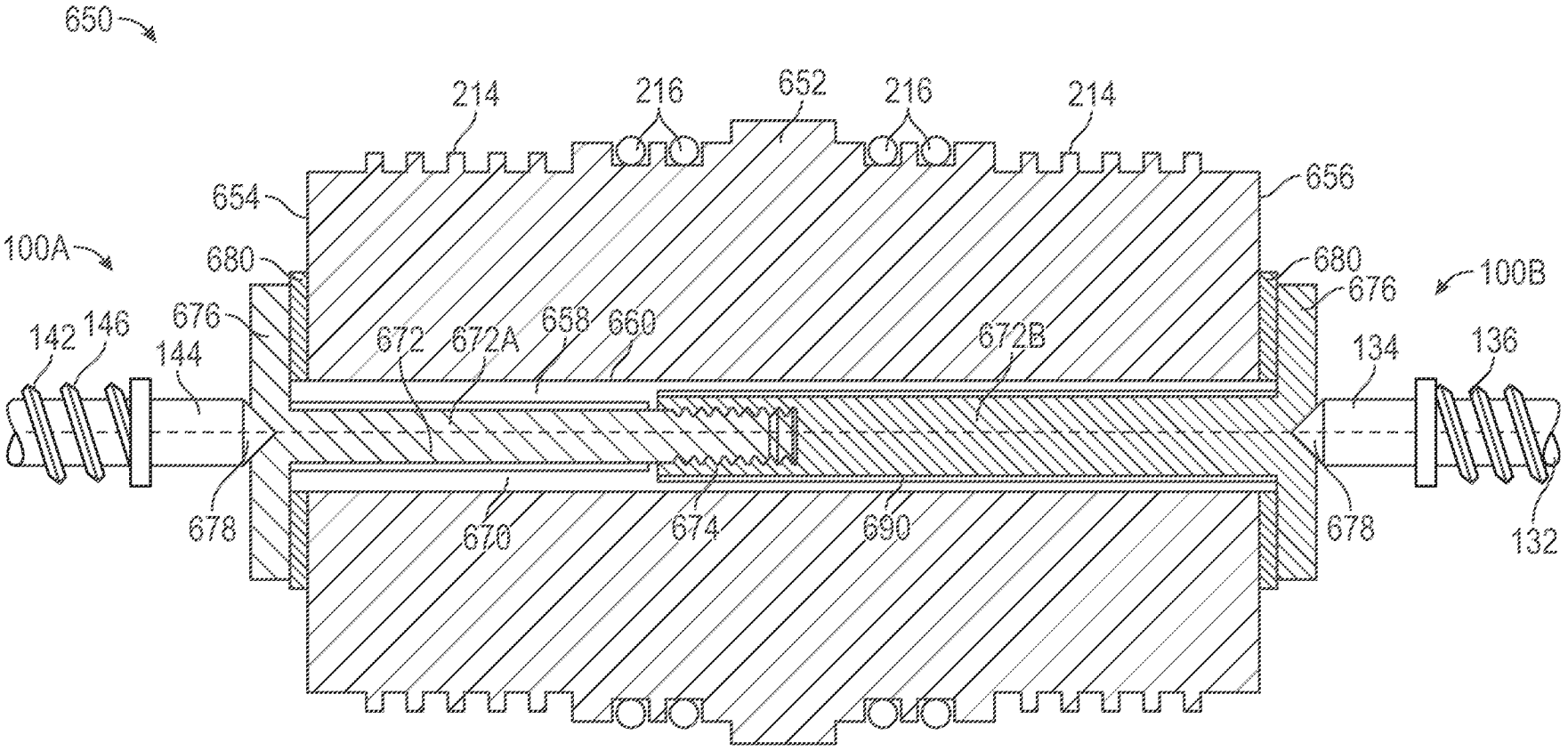

Referring to FIG. 17, another embodiment of a tandem sub 650 is shown which may be used in conjunction with or in lieu of the tandem sub 200 shown in FIGS. 4-7. Tandem sub 650 may include features in common with tandem sub 200 shown in FIGS. 4-7, and shared features are labeled similarly. Tandem sub 650 generally includes an outer housing 652 and a pressure bulkhead or pass-thru assembly 670. Outer housing 652 generally includes a first end 654, a second end 656 opposite first end 652, and a central bore or passage 658 defined by a generally cylindrical inner surface 660. In this embodiment, each end 654, 656 of outer housing 652 may comprise an annular endface that is generally planar.

The pass-thru assembly 670 of tandem sub 650 generally comprises an inner electrical connector or signal bar assembly 672 and a generally cylindrical outer insulator 690. In this embodiment, signal bar assembly 672 comprises a pair of signal bars 672A, 672B which are coupled together at a threaded coupling 674 formed therebetween when tandem sub 650 is assembled. Each signal bar 672A, 672B comprises an outer annular endplate 676 having a conical recess or receptacle 678 formed therein and configured to receive one of the contact pins 134, 144 of electrical connectors 132, 142, respectively. Each endplate 676 is positioned external the central passage 658 of outer housing 652 and has a diameter that is greater than a maximum inner diameter of the inner surface 660 of outer housing 652. Endplates 676 are each electrically insulated from outer housing 652 by a pair of electrically insulating, disc shaped gaskets or pads 680 which are positioned axially between the endplates 676 and the ends 654, 656 of outer housing 652. In other embodiments, endplates 676 may each be partially coated or overmolded by an electrically insulating material (excluding conical receptacles 678) to electrically insulate endplates 676 from outer housing 652 without needing to use insulating pads 680. The portions of signal bars 672A, 672B positioned within the central passage 658 of outer housing 652 are electrically insulated from housing 652 by the cylindrical insulator 690 which is overmolded or otherwise coated onto (e.g., anodized, etc.) signal bars 672A, 672B. In other embodiments, signal bars 672A, 672B may not include insulator 690 and instead a radial gap formed between the outer surfaces 672A, 672B and the inner surface 660 of outer housing 652 may ensure that signal bars 672A, 672B are not electrically connected to outer housing 652.

In this embodiment, tandem sub 650 may be assembled by inserting signal bars 672A, 672B into central passage 658 at ends 654, 656 respectively with an insulating pad 680 positioned adjacent each endplate 676. Signal bars 672A, 672B may be threadably connected together to form threaded connection 674 such that signal bars 672A, 672B are secured together thereby forming signal bar assembly 672 which is axially locked to the outer housing 652 of tandem sub 650. In this configuration, tandem sub 650 may be assembled with perforating guns 100A, 100B (partially shown in FIG. 17) whereby tandem sub 650 may provide an electrical connection between guns 100A, 100B while preventing the communication of pressure from upper perforating gun 100A to lower perforating gun 100B and from lower perforating gun 100B to upper perforating gun 100A.

Figure 18:
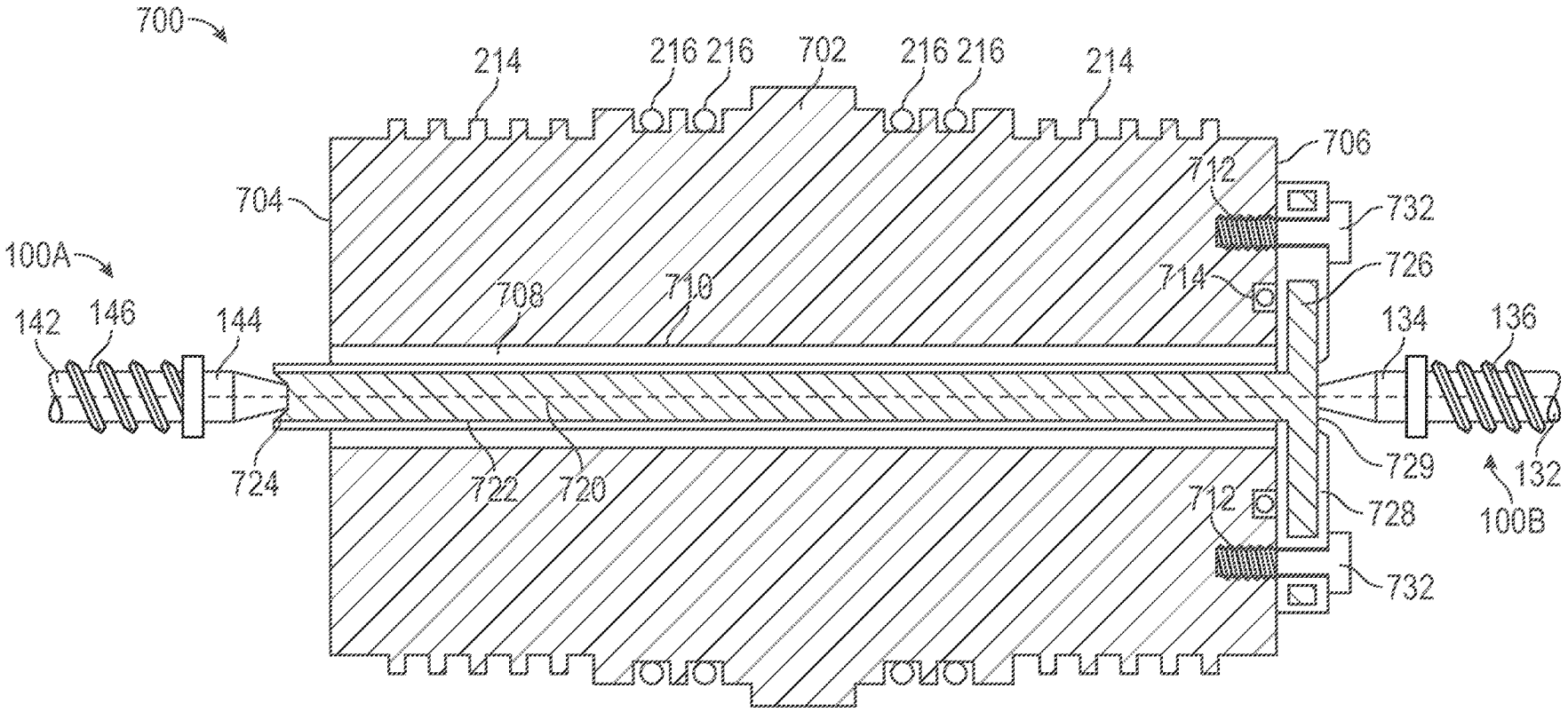

Referring to FIG. 18, another embodiment of a tandem sub 700 is shown which may be used in conjunction with or in lieu of the tandem sub 200 shown in FIGS. 4-7. Tandem sub 700 may include features in common with tandem sub 200 shown in FIGS. 4-7, and shared features are labeled similarly. Tandem sub 700 generally includes an outer housing 702 and a pressure bulkhead or pass-thru assembly 720. Outer housing 702 generally includes a first end 704, a second end 706 opposite first end 704, and a central bore or passage 708 defined by a generally cylindrical inner surface 710. In this embodiment, each end 704, 706 of outer housing 702 may comprise an annular endface that is generally planar.

The pass-thru assembly 720 of tandem sub 700 generally comprises an electrical connector or signal bar 722. Signal bar 722 comprises a first end which includes a conical recess or receptacle 724 and a second end, opposite the first end, which comprises an annular endplate 726. The pin connector 144 of the electrical connector 142 of upper perforating gun 100A may be received within the conical receptacle 724 of signal bar 722 to establish electrical communication with upper perforating gun 100A. Endplate 726 is positioned external the central passage 708 of outer housing 702 and is covered by an electrical insulator 728 except for an outer opening 730 positioned at a center of endplate 726 and facing the pin connector 134 of the electrical connector 132 of lower perforating gun 100B. Insulator 728 may be overmolded or otherwise coated (e.g., anodized, etc.) onto endplate 728 to thereby electrically insulate endplate 728 from outer housing 702. In other embodiments, an O-ring, an annular or disc shaped gasket, or other electrically insulating member may be used to insulate endplate 728 from outer housing 702 in lieu of insulator 728.

To assemble tandem sub 700 the signal bar 722 may be inserted through the central passage 708 of outer housing 702 such that endplate 726 is positioned directly adjacent the second end 706 of outer housing 702. In this position, a plurality of fasteners 732 may be extended through apertures formed in endplate 728 and threadably connected to receptacles 712 formed in the second end 706 of outer housing 702, thereby retaining signal bar 722 to outer housing 702 such that relative movement therebetween is restricted. Perforating guns 100A, 100B may then be coupled with tandem sub 700 to establish an electrical connection therebetween via signal bar 722. Additionally, the insulator 728 covering endplate 726 may be clamped against an annular seal or O-ring 714 positioned in a groove formed on the second end 706 of outer housing 702 to prevent the communication of pressure from lower perforating gun 100B to upper perforating gun 100A, and from upper perforating gun 100A to lower perforating gun 100B.

Figure 19:
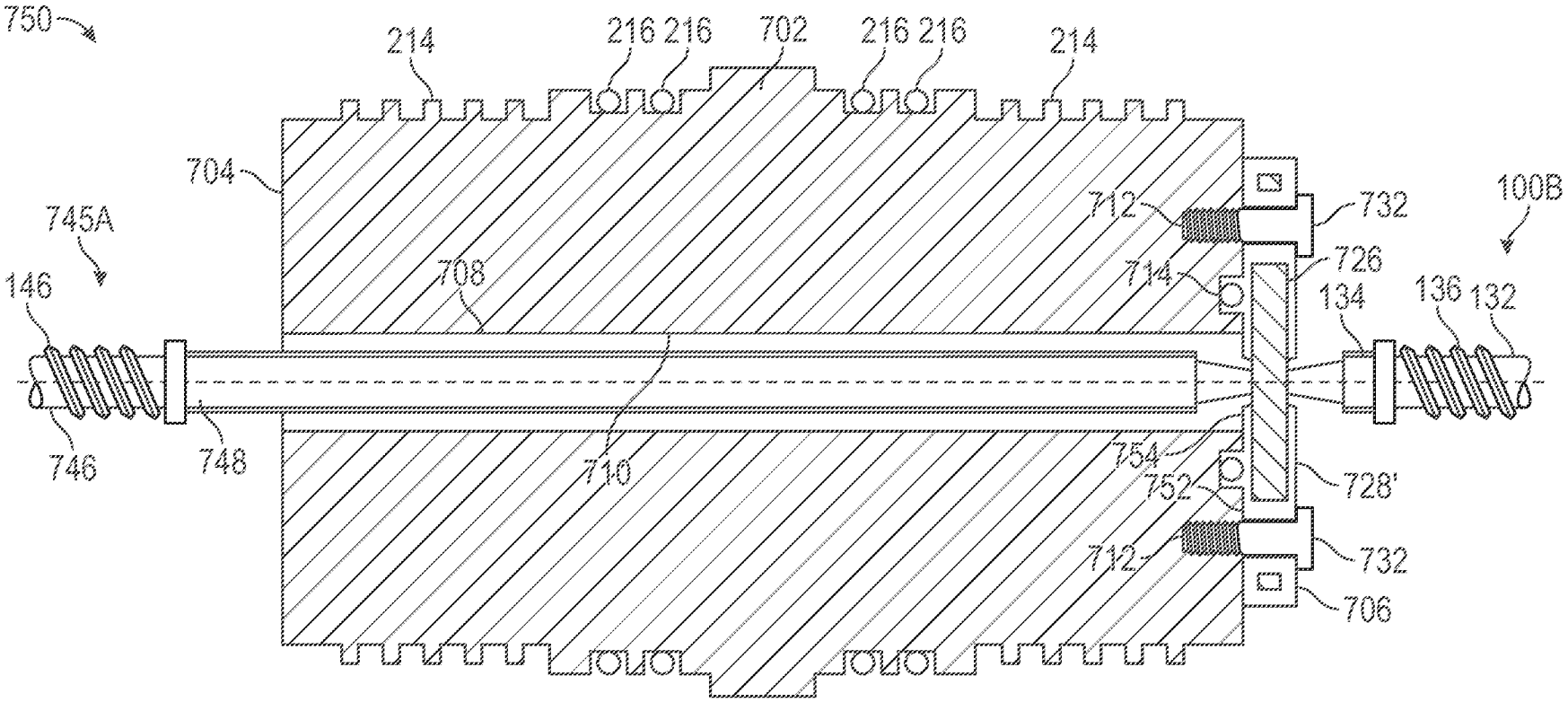

Referring to FIG. 19, another embodiment of a tandem sub 750 is shown which may be used in conjunction with or in lieu of the tandem sub 200 shown in FIGS. 4-7. Tandem sub 750 may include features in common with tandem sub 200 shown in FIGS. 4-7 and the tandem sub 700 shown in FIG. 18, and shared features are labeled similarly. Particularly, tandem sub 750 is similar to tandem sub 700 shown in FIG. 18 except that a pressure bulkhead or pass-thru assembly 752 of tandem sub 700 only includes endplate 726 and an associated insulator 728', and does not include the signal bar 722. In this embodiment, tandem sub 750 is configured to electrically connect and provide bi-directional pressure isolation between an upper perforating gun 745A (partially shown in FIG. 19) and the lower perforating gun 100B. Upper perforating gun 745A is similar to upper perforating gun 100A except an electrical connector 746 coupled to lower endplate 140 (not shown in FIG. 19) of upper perforating gun 745A has an extended pin connector 748 which extends entirely through the central passage 708 of the outer housing 702 of tandem sub 750 and contacts the conductive endplate 726 via an inner opening 754 formed in the insulator 728'.

Figure 20:
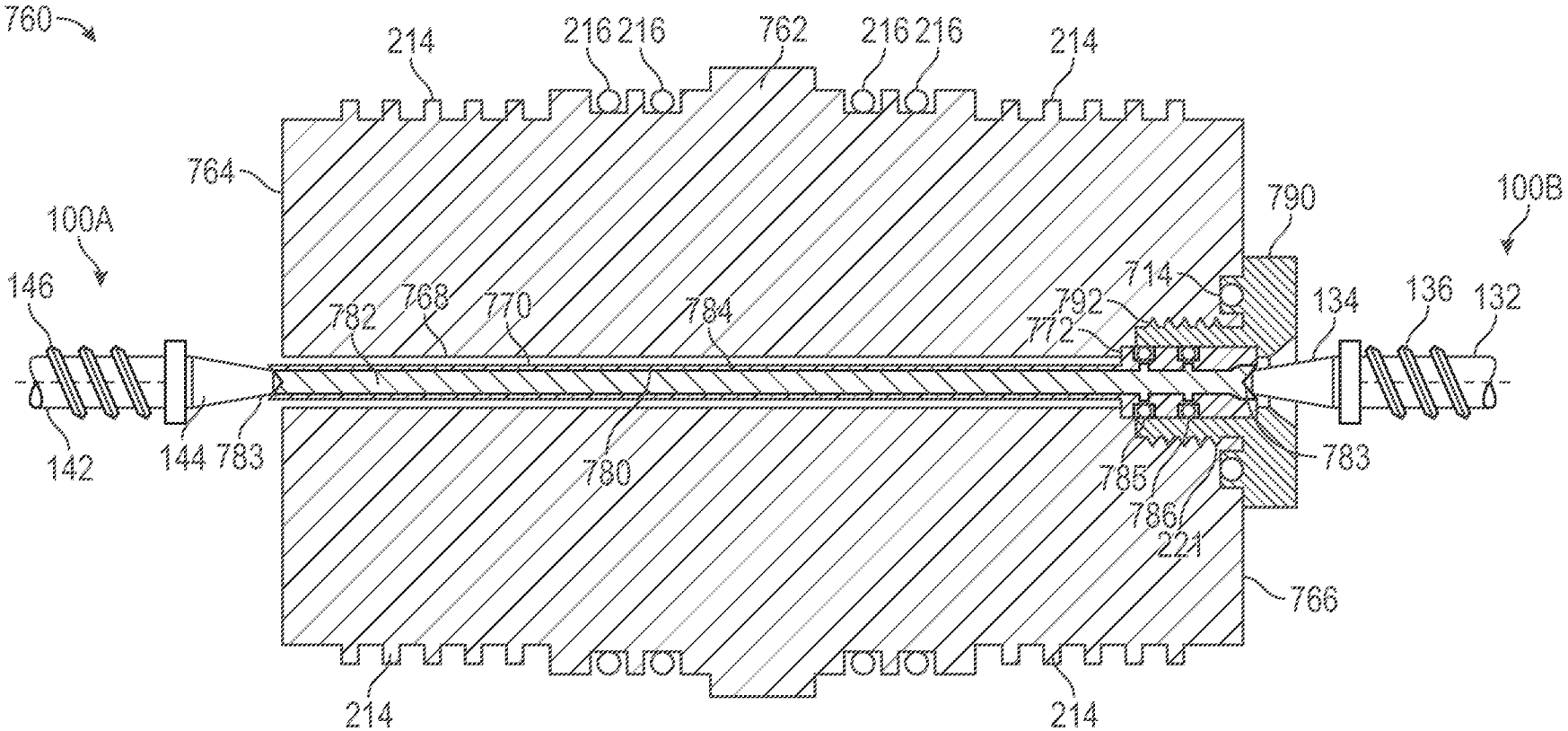

Referring to FIG. 20, another embodiment of a tandem sub 760 is shown which may be used in conjunction with or in lieu of the tandem sub 200 shown in FIGS. 4-7. Tandem sub 760 may include features in common with tandem sub 200 shown in FIGS. 4-7, and shared features are labeled similarly. Tandem sub 760 generally includes an outer housing 762, a pressure bulkhead or pass-thru assembly 780, and a retainer 790. Outer housing 762 generally includes a first end 764, a second end 766 opposite first end 764, and a central bore or passage 768 defined by a generally cylindrical inner surface 770. In this embodiment, each end 764, 766 of outer housing 762 may comprise an annular endface that is generally planar.

In this embodiment, feed-thru assembly 780 generally includes an electrical connector or signal bar 782 which is covered by a generally cylindrical outer insulator 784 with the exception of a pair of conical recesses or receptacles 783 formed in opposing ends of signal bar 782. Conical receptacles 783 are configured to receive the pin connectors 144, 134 of the electrical connectors 132, 142 of perforating guns 100A, 100B, respectively, whereby perforating guns 100A, 100B may be electrically connected via signal bar 782.

In this embodiment, outer insulator 784 may be overmolded or otherwise coated (e.g., anodized, etc.) onto an outer surface of signal bar 782 such that rod 782 is electrically insulated from outer housing 762. An outer surface of outer insulator 784 comprises a shoulder 785 which engages a corresponding shoulder 772 of outer housing 762. Additionally, a pair of annular seal assemblies or O-rings 786 are positioned in corresponding grooves formed on the outer surface of outer insulator 784 and which sealingly engage an inner surface of the retainer 790. Retainer 790 comprises a releasable or threaded connector 792 formed on an outer surface thereof which threadably connects to internal threads 221 of outer housing 762. An end of the outer insulator 784 may contact a shoulder 794 formed on the inner surface of insulator 784 which may, in concert with engagement with shoulder 772 of outer housing 762) retain pass-thru assembly 780 to outer housing 762. Additionally, the outer surface of retainer 790 sealingly engages an annular seal or O-ring 774 positioned in a groove formed on the second end 766 of outer housing 762. The sealing engagement provided by O-rings 786 of pass-thru assembly 780 and by O-ring 774 of outer housing 762 may bi-directionally pressure isolate the perforating guns 100A, 100B from each other such that pressure cannot be communicated across tandem sub 760.

Figure 21:
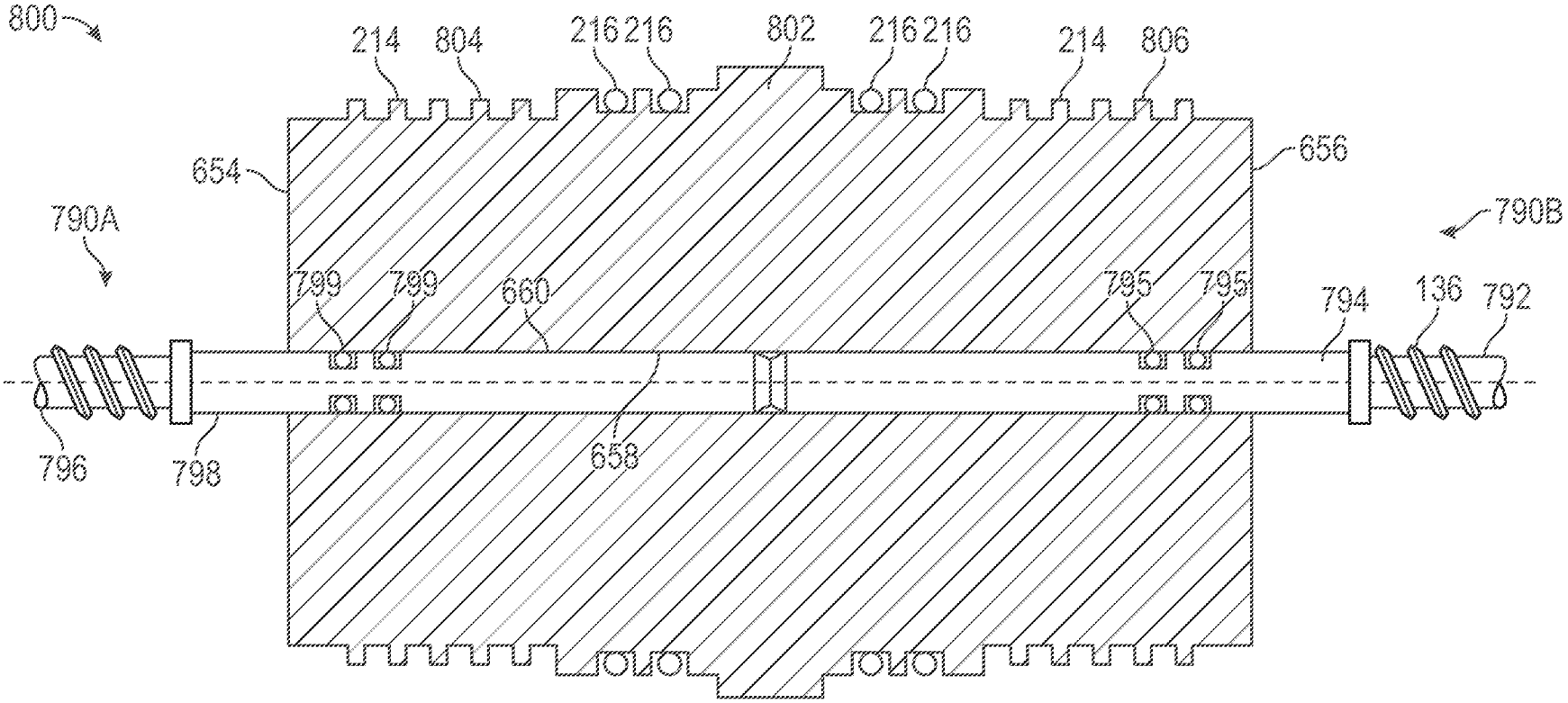

Referring to FIG. 21, another embodiment of a tandem sub 800 is shown which may be used in conjunction with or in lieu of the tandem sub 200 shown in FIGS. 4-7. Tandem sub 800 may include features in common with tandem sub 200 shown in FIGS. 4-7 and tandem sub 650 shown in FIG. 17, and shared features are labeled similarly. Tandem sub 800 generally includes an outer housing 802. Outer housing is similar to the outer housing 652 of the tandem sub 650 shown in FIG. 17; however, outer housing 802 is formed or comprises an electrically insulating material. In some embodiments, an electrically conductive coating 806 may be applied to an outer surface 804 of outer housing 802 extending between ends 654, 656. Coating 806 may provide a path for an electrical ground for components coupled downhole from tandem sub 800.

Additionally, instead of electrically connecting and providing pressure isolation between perforating guns 100A, 100B as with tandem sub 650 shown in FIG. 17, tandem sub 800 is configured to electrically connect and provide bi-directional pressure isolation between an upper perforating gun 790A (partially shown in FIG. 21) and a lower perforating gun 790B (also partially shown in FIG. 21). Perforating guns 790A, 790B are similar to perforating guns 100A, 100B, respectively, except that electrical connectors 792, 796 coupled to endplates 130, 140 (not shown in FIG. 21), respectively, comprise extended pin connectors 794, 798, respectively, which extend through the central passage 658 of outer housing 802.

In this configuration, terminal ends of pin connectors 794, 798 contact each other within central passage 658 of outer housing 802 to form an electrical connection between perforating guns 790A, 790B. Given that outer housing 802 comprises an electrically insulating material, contact pins 794, 798 are not electrically connected to outer housing 802. However, in other embodiments, outer housing 802 may comprise an electrically conductive material (and thus may not include conductive coating 806) and contact pins 794, 798 may each be covered by an electrically insulating material that is overmolded or coated onto (e.g., anodized, etc.) an outer surface of each contact pin 794, 798. In still other embodiments, the inner surface 660 of outer housing 802 may be covered by an electrically insulating material. The insulating material may be molded or coated (e.g., anodized, etc.) onto the inner surface 660 of outer housing 802 to thereby electrically insulate contact pins 794, 798 from outer housing 802.

Additionally, in this embodiment, a pair of annular seals or O-rings 795, 799 are positioned in grooves formed on the outer surfaces of contact pins 794, 798, respectively. O-rings 795, 799 seal against the inner surface 660 of outer housing 802 to thereby prevent the communication of pressure across tandem sub 800. In this manner, pressure in lower perforating gun 790B may be isolated or prevented from being communicated to upper perforating gun 790A, and pressure in upper perforating gun 790A may be isolated or prevented from being communicated to lower perforating gun 790B.

Figure 22:
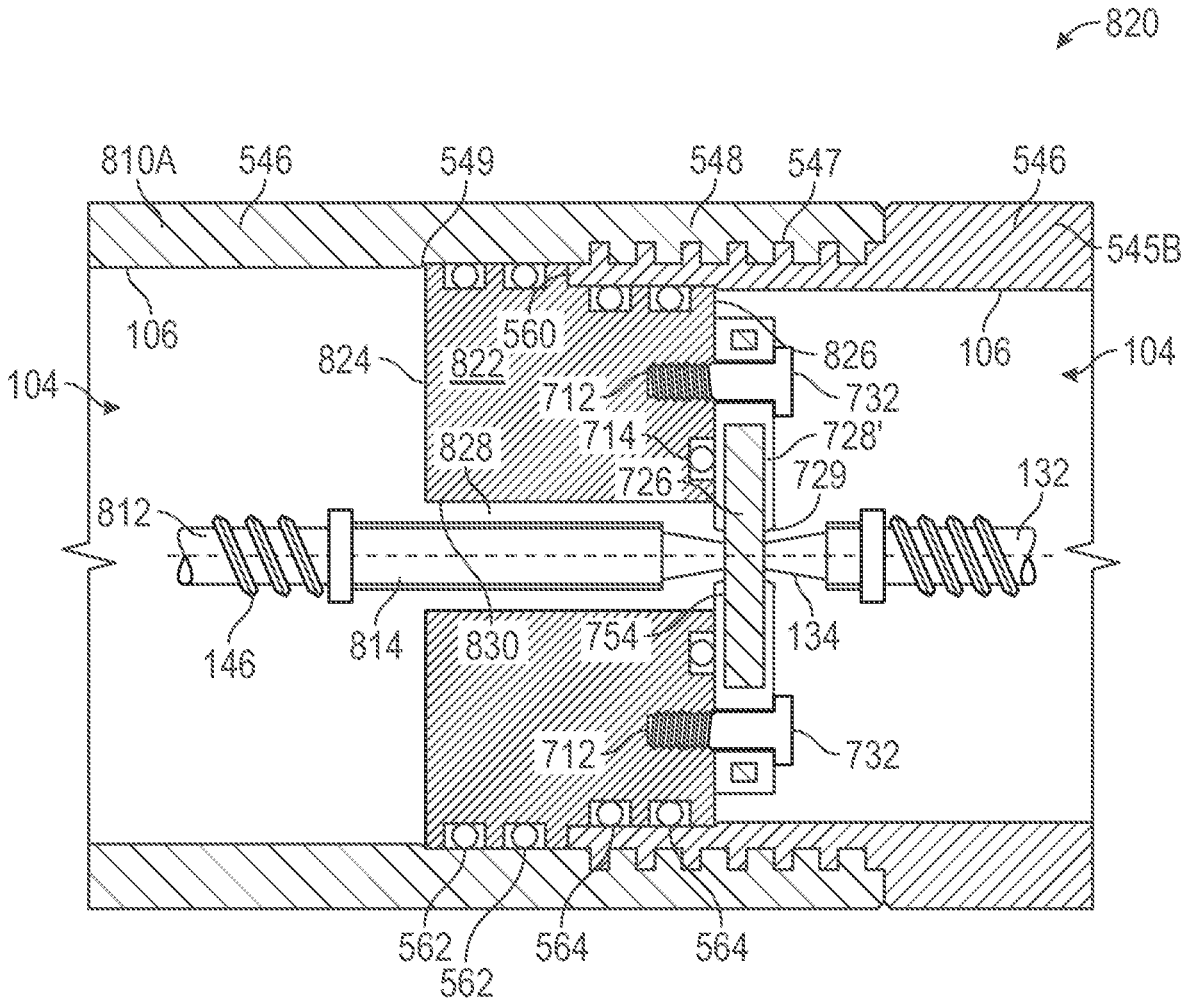

Referring to FIG. 22, another embodiment of a tandem sub 820 is shown which may be used in conjunction with or in lieu of the tandem sub 200 shown in FIGS. 4-7. Tandem sub 820 may include features in common with tandem sub 200 shown in FIGS. 4-7, tandem sub 550 shown in FIG. 15, and tandem sub 750 shown in FIG. 19, and shared features are labeled similarly. Tandem sub 820 generally includes an outer housing 822 and the conductive endplate 726 partially covered by insulator 728' and secured to outer housing 822 by fasteners 732. Outer housing 822 generally includes a first end 824, a second end 824 opposite first end 822, and a central bore or passage 828 defined by a generally cylindrical inner surface 830 extending between ends 824, 826. As with tandem sub 750 shown in FIG. 19, outer housing 822 includes receptacles 712 for receiving fasteners 732 and O-ring 714 for sealing against the insulator 728'.]

Tandem sub 820 is generally configured to provide an electrical connection and bi-directional pressure isolation between a first or upper perforating gun 840A and lower perforating gun 545B (similar to the lower perforating gun 545B shown in FIG. 15). Upper perforating gun 840A is similar to the upper perforating gun 545A shown in FIG. 15 except an electrical connector 842 coupled to lower endplate 140 (not shown in FIG. 22) of upper perforating gun 840A has an extended pin connector 844 which extends entirely through the central passage 828 of the outer housing 822 and contacts the conductive endplate 726 via the inner opening 754 formed in the insulator 728'. In this manner, an electrical connection is provided between perforating guns 840A, 545B via conductive endplate 726 while pressure in lower perforating gun 545B is isolated or prevented from being communicated to upper perforating gun 840A, and pressure in upper perforating gun 840A is isolated or prevented from being communicated to lower perforating gun 545B, While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. As an example, while contact pins 134, 144 of the electrical connectors 132, 142 described above are shown as conical and receivable within a corresponding conical receptacle; in other embodiment, contact pins 134, 144 (as well as other contact pins described above) may comprise planar or flat endfaces which contact corresponding planar or flat endfaces to establish an electrical connection therebetween.

The relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A tandem sub for a perforating gun system, comprising:

a tubular housing comprising a longitudinal first end, a longitudinal second end opposite the first end, a central passage defined by an inner surface, wherein the housing is connectable to an outer housing of a perforating gun; and an electrical pass-thru assembly configured to electrically connect to the perforating gun and comprising an electrically conductive signal bar having a longitudinal first end defining a first electrical contact of the tandem sub and configured to establish an electrical connection with a first electrical component separate from and external the tandem sub, and a longitudinal second end opposite the first end and defining a second electrical contact of the tandem sub that is longitudinally opposite and electrically connected to the first electrical contact and configured to establish an electrical connection with a second electrical component separate from and external the tandem sub, wherein the signal bar is rigid along the entire longitudinal length thereof extending from the first end to the second end;

wherein the signal bar is coupled to the housing and a central axis of the central passage of the housing intersects the signal bar; and wherein the pass-thru assembly comprises a molded insulator sealably adhered to an outer surface of the signal rod and to the inner surface of the central passage of the housing, the molded insulator adhered continuously across the entire longitudinal length of the signal bar.

2. The tandem sub of claim 1, wherein the signal bar is positioned in the central passage of the housing.

3. The tandem sub of claim 2, wherein the central passage of the housing comprises a longitudinal first end, a longitudinal second end opposite the first end, and wherein the pass-thru assembly creates a pressure seal between the first end and the second end of the central passage.

4. The tandem sub of claim 1, wherein the molded insulator comprises a pair of opposing longitudinal ends, and wherein each longitudinal end of the molded insulator comprises a concave receptacle.

5. The tandem sub of claim 4, wherein both the first end and the second end of the signal bar comprises a concave receptacle, and wherein the concave receptacles of the molded insulator are flush with the conical receptacles of the signal bar.

6. The tandem sub of claim 1, wherein the signal bar is disk-shaped and coupled to one of the first end and the second end of the tubular housing.

7. The tandem sub of claim 1, wherein both the first end and the second end of the signal bar comprises a concave receptacle configured to receive a contact pin.

8. The tandem sub of claim 1, wherein neither the first end nor the second end of the signal bar is biased outwardly from the central passage of the tubular housing by a biasing member.

9. The tandem sub of claim 1, wherein the longitudinal length of the signal bar is greater than half the longitudinal length of the central passage of the tubular housing.

10. A tandem sub for a perforating gun system, comprising:

a tubular housing comprising a longitudinal first end, a longitudinal second end opposite the first end, a central passage defined by an inner surface, wherein the housing is connectable to an outer housing of a perforating gun; and an electrical pass-thru assembly configured to electrically connect to the perforating gun and comprising an electrically conductive signal bar having a longitudinal first end defining a first electrical contact of the tandem sub and configured to establish an electrical connection with a first electrical component separate from and external the tandem sub, and a longitudinal second end opposite the first end and defining a second electrical contact of the tandem sub that is longitudinally opposite and electrically connected to the first electrical contact and configured to establish an electrical connection with a second electrical component separate from and external the tandem sub, wherein neither the first end nor the second end of the signal bar is biased outwardly from the central passage of the tubular housing by a biasing member;

wherein the signal bar is coupled to the housing and a central axis of the central passage of the housing intersects the signal bar, and wherein both the first end and the second end of the signal bar comprises a concave receptacle.

11. The tandem sub of claim 10, wherein the signal bar is rigid along the entire longitudinal length thereof extending from the first end to the second end.

12. The tandem sub of claim 10, wherein the longitudinal length of the signal bar is greater than half the longitudinal length of the central passage of the tubular housing.

13. The tandem sub of claim 10, wherein the pass-thru assembly comprises a molded insulator sealably adhered to an outer surface of the signal rod and to the inner surface of the central passage of the housing.

14. The tandem sub of claim 13, wherein an outer surface of the signal bar and an inner surface of the tubular housing of the tandem sub comprise one or more protrusions configured to interlockingly engage with protrusions of the molded insulator.

15. A tandem sub for a perforating gun system, comprising:

a tubular housing comprising a longitudinal first end, a longitudinal second end opposite the first end, a central passage defined by an inner surface, wherein the housing is connectable to an outer housing of a perforating gun; and an electrical pass-thru assembly configured to electrically connect to the perforating gun and comprising an electrically conductive, disk-shaped signal bar having a longitudinal first end defining a first electrical contact of the tandem sub and configured to establish an electrical connection with a first electrical component separate from and external the tandem sub, and a longitudinal second end opposite the first end and defining a second electrical contact of the tandem sub that is longitudinally opposite and electrically connected to the first electrical contact and configured to establish an electrical connection with a second electrical component separate from and external the tandem sub, wherein the signal bar is rigid along the entire longitudinal length thereof extending from the first end to the second end;

wherein the signal bar is coupled to one of the first end and the second end of the housing and a central axis of the central passage of the housing intersects the signal bar.

16. The tandem sub of claim 15, wherein the signal bar is positioned at least partially exterior of the central passage of the housing.

17. The tandem sub of claim 15, wherein the signal bar is positioned entirely exterior of the central passage of the housing.

* * * * *